US006986605B1

(12) United States Patent
Allen et al.

(10) Patent No.: US 6,986,605 B1
(45) Date of Patent: Jan. 17, 2006

(54) MULTIWALL VENTED BAG, VENTED BAG FORMING APPARATUS, AND ASSOCIATED METHODS

(75) Inventors: John R. Allen, Tifton, GA (US); Richard Henry Busbin, Chula, GA (US)

(73) Assignee: Exopack-Technology, LLC, Spartanburg, SC (US)

( * ) Notice: Subject to any disclaimer, the term of this patent is extended or adjusted under 35 U.S.C. 154(b) by 164 days.

(21) Appl. No.: 10/421,607

(22) Filed: Apr. 23, 2003

(51) Int. Cl.
*B65D 33/01* (2006.01)

(52) U.S. Cl. ..... 383/101; 383/111

(58) Field of Classification Search ..... 383/100–103, 383/111
See application file for complete search history.

(56) References Cited

U.S. PATENT DOCUMENTS

| | | | | |
|---|---|---|---|---|
| 2,593,328 | A | 4/1952 | Meaker | |
| 2,870,954 | A * | 1/1959 | Kulesza | 206/524.8 |
| 2,997,224 | A * | 8/1961 | Stannard | 206/439 |
| 3,026,656 | A | 3/1962 | Rumsey | |
| 3,092,249 | A | 6/1963 | Chapman | |
| 3,302,859 | A | 2/1967 | Perry | |
| 3,370,780 | A | 2/1968 | Shaw | |
| 3,394,871 | A | 7/1968 | Williams | |
| 3,439,869 | A | 4/1969 | Shrum | |
| 3,468,471 | A | 9/1969 | Linder | |
| 3,628,720 | A * | 12/1971 | Schmedding | 383/101 |
| 3,807,626 | A | 4/1974 | Goodrich | |
| 3,910,488 | A | 10/1975 | Goodrich | |
| 3,958,749 | A | 5/1976 | Goodrich | |
| 3,989,182 | A | 11/1976 | Stearley | |
| 4,026,460 | A | 5/1977 | May | |
| 4,057,144 | A | 11/1977 | Schuster | |
| 4,071,187 | A | 1/1978 | LaFleur | |
| 4,088,264 | A | 5/1978 | Vogt | |
| 4,328,909 | A | 5/1982 | Jeans | |
| 4,470,153 | A | 9/1984 | Kenan | |
| 4,493,127 | A | 1/1985 | Blanke | |
| 4,550,441 | A | 10/1985 | Keppel | |
| 4,743,123 | A * | 5/1988 | Legters et al. | 383/103 |
| 4,821,896 | A | 4/1989 | Cheng | |
| 4,946,289 | A | 8/1990 | Bolling | |
| 4,952,441 | A | 8/1990 | Bose | |
| 4,994,324 | A | 2/1991 | Bose | |

(Continued)

FOREIGN PATENT DOCUMENTS

| | | |
|---|---|---|
| DE | 1536367 | 12/1969 |

(Continued)

*Primary Examiner*—Jes F. Pascua
(74) *Attorney, Agent, or Firm*—Bracewell & Giuliani LLP

(57) ABSTRACT

A multiwall vented bag is provided which includes an inner tube formed of a plastic material. The inner tube has an open end initially in an open position and adapted to receive filling material therein and at least one vent opening formed therein. The bag further includes a strip of material positioned adjacent and attached to a preselected region of the inner tube. The preselected region includes the at least one vent opening of the inner tube. The strip also includes at least one vent opening to allow air to pass from within the inner tube, through both the at least one vent opening of the inner tube and the at least one vent opening of the strip. The bag further includes an outer tube positioned to substantially surround outer surfaces of the inner tube. The outer tube is formed of a porous material that allows air released from within the inner tube to pass out of the bag through porous material of the outer tube. A method of forming and using a vented bag are also included.

18 Claims, 12 Drawing Sheets

U.S. PATENT DOCUMENTS

| | | | | | |
|---|---|---|---|---|---|
| 5,038,009 | A | | 8/1991 | Babbitt | |
| 5,171,594 | A | | 12/1992 | Babbitt | |
| 5,281,027 | A | | 1/1994 | Thrall | |
| 5,345,399 | A | | 9/1994 | Collins | |
| 5,399,022 | A | * | 3/1995 | Sheets | 383/103 |
| 5,482,376 | A | | 1/1996 | Moseley | |
| 5,488,220 | A | | 1/1996 | Freerks | |
| 5,529,396 | A | | 6/1996 | Pryor | |
| 5,553,942 | A | * | 9/1996 | Domke et al. | 383/101 |
| 5,553,943 | A | | 9/1996 | Cook et al. | |
| 5,560,296 | A | | 10/1996 | Adams | |
| 5,601,369 | A | | 2/1997 | Moseley | |
| 5,728,037 | A | | 3/1998 | Pryor | |
| 5,770,839 | A | | 6/1998 | Ruebush | |
| 5,871,790 | A | | 2/1999 | Monier | |
| 5,902,046 | A | * | 5/1999 | Shibata | 383/107 |
| 5,911,508 | A | | 6/1999 | Dobreski et al. | |
| 6,019,713 | A | | 2/2000 | Scypinski | |
| 6,030,652 | A | | 2/2000 | Hanus | |
| 6,046,443 | A | | 4/2000 | Ackerman | |
| 6,213,644 | B1 | | 4/2001 | Henderson | |
| 6,240,709 | B1 | | 6/2001 | Cook | |
| 6,374,461 | B1 | | 4/2002 | Gober | |
| 6,423,053 | B1 | | 7/2002 | Lee | |
| 6,446,796 | B1 | | 9/2002 | Schmidt | |
| 6,478,465 | B1 | | 11/2002 | Thrall | |
| 6,481,891 | B2 | | 11/2002 | Yeager | |
| 2001/0046334 | A1 | | 11/2001 | Yeager | |
| 2002/0185188 | A1 | | 12/2002 | Quigley et al. | |

FOREIGN PATENT DOCUMENTS

| | | | |
|---|---|---|---|
| DE | 0148436 | * | 5/1981 |
| EP | 961222 | | 6/1964 |
| EP | 0 767 105 A1 | | 4/1997 |
| FR | 2256660 | * | 7/1975 |
| IT | 1016476 | | 1/1966 |
| JP | 02109859 A | | 4/1990 |
| JP | 2000158561 A | | 6/2000 |
| JP | 2001047126 A | | 2/2001 |
| NL | 68067715 | * | 7/1968 |
| WO | WO 97/29966 | | 8/1997 |

* cited by examiner

MULTIWALL VENTED BAG, VENTED BAG FORMING APPARATUS, AND ASSOCIATED METHODS

BACKGROUND OF THE INVENTION

1. Field of the Invention

The present invention relates generally to the packaging industry. In more specific aspects, the present invention relates to multiwall packaging and methods for forming multiwall packaging that have vents associated therewith.

2. Description of the Related Art

As more and more industrial, commercial, and consumer products are packaged, the need for enhanced end product packaging continues to grow. End product packaging not only has to keep the products fresh, the product packaging often needs to protect the environment from the product contents and protect the product contents from the environment. The packaging must also be strong enough to hold materials of varying weights, without being damaged, in order to provide packaging for a vast array of consumer products.

Of particular importance is often the ability to extract the contents of a package such as a bag without contaminating the contents with a contaminated outer surface of the bag. Various bags have been developed in attempts to satisfy this requirement. The typical bag includes integrated inner and outer plies, a flexible sheet material formed into a tubular form, and the tubular form being converted into an open mouth bag. At least one ply of the flexible sheet material for the bag can be coated with a moisture impervious plastic coating, laminated with a waterproof material, or be formed of a waterproof material. One such bag, for example, can be seen in U.S. Pat. No. 4,088,264 by Vogt titled "Multiwall Pouch Bags Or Detached Packaging Of Commodities." The bag is formed by first heat sealing and severing an inner plastic tube from an outer paper tube to form a pouch of the inner tube. The inner tube is attached to the outer tube only at the open bag end. The outer plies are closed at a distance below the sack in a sewn or pinch bottom closure to close the bag at the closed end. After the bag is filled at the open end with a commodity to be packaged, the inner pouch into which the commodity is loaded is heat sealed to closure adjacent the open end and also severed from that end in a manner similar to severing the lower end of the inner pouch. As packaged, the commodity is contained within a sealed, sift and leak proof, inner pouch which is housed within a sealed outer tube for protection against environmental concerns such as contamination and insect penetration. A significant difficulty arises, however, when air is trapped in the inner pouch of the bag prior to sealing.

In such situations, it is important to permit air or gas release after the bag has been packed and the open end of the bag and the plastic pouch or poly liner have been sealed. It is also important to prevent contamination due to the venting of the trapped air. Applicants have recognized that when the plastic liner inside an unvented bag is sealed after being filled, it traps air and causes the bag to be difficult to handle and stack. The unvented bags essentially have a balloon affect after being sealed. There is also the risk that end seals in unvented bags will rupture during stacking processes due to excess pressure being applied. This problem is accentuated where the facility filling the bags is located at a different pressure altitude than a destination facility. Vents made by piercing a single ply plastic pouch or liner have been found to be ineffective as they allow material to sift out and insects to infest the material inside which often consists of food or pharmaceutical grade product. To allow venting of trapped air, others have developed various types of bags with various methodologies of venting.

Some of the first attempts included perforating the bag with very small holes in order to vent the trapped air. For example, U.S. Pat. No. 2,593,328 by Meaker titled "Perforated Multiple Ply Bag" describes a waterproof bag formed of electrically perforated paper. Each of the plies that form the body of the bag is electrically perforated to provide minute burrless perforations through which air trapped in the bag during filling may escape. The perforations are small enough to prevent the commodity with which the bag is filled from passing through the perforations or outside water from entering such perforations.

Another methodology includes using a single vent valve-type bag. For example, U.S. Pat. No. 3,958,749 by Linder et al. titled "Bacteria Proof Plastic Bag For Articles To Be Sterilized" describes a bag having a single valve which is gas and steam permeable at increased temperatures and which closes at a given normal temperature so that no bacteria can enter. The valve includes a filter device formed of a layer of water-soluble adhesive, a gas permeable layer, and a heat resistant adhesive having a plurality of holes. Also, U.S. Pat. No. 3,989,182 by Stearley titled "Vented Bag" describes a bag including a valve member which is positioned between one of the end flaps of the overlapped side flaps and a plurality of venting perforations formed in one of the end walls for providing venting of the interior of the bag to the atmosphere.

Yet another methodology developed has been the formulation of the bag using overlapping perforated margins from a continuous web of flexible plastic material. For example, U.S. Pat. No. 3,302,859 by Perry titled "Bag" describes a bag having a longitudinal seam including overlapping margins of plastic material from which a tube is formed. The margins are secured together using two spaced longitudinal seams of adhesive. Each margin has a series of tongues for the escape of air from the bag whereby the tongues in one margin are offset from the tongues in the other. U.S. Pat. No. 4,470,153 by Kenan titled "Multiwall Pouch Bags with Vent Strip" expanded on this design. The Kenan patent describes a bag having an interior plastic pouch formed from a sealed plastic tube having a longitudinal seam created by overlapping tube margins. The margins forming the longitudinal seam are secured together using two spaced-apart longitudinal seams of adhesive placed on opposite sides of a filter type spacer. The inner margin has a series of holes that allow air to escape from inside the interior plastic pouch into a channel formed between the inner and outer margins. Air escapes from the channel either through a set of holes in the outer margin or through a heat seal closure. Also, U.S. Pat. No. 4,550,441 by Keppel titled "Vented Bag" further developed this methodology. The Keppel patent describes a multiwall commodity bag as an improvement upon U.S. Pat. No. 4,470,153 by Kenan where in lieu of a series of vent holes or openings along one or both of the overlapped margins of the channel, a small hole the size of a pinhole is formed through the inner side of the center of the overlap forming the channel near one end. A small hole is also formed through the outer side and near the center of the channel adjacent the other or opposite end of the plastic pouch. Applicants have recognized that these type of seamed bags, however, can have problems with seam overlap alignment and can be complex to manufacture.

Also, bags have been developed that attempt not only allow the protection of the contents from contamination yet are capable of releasing trapped air, and allow for the extraction of the contents without contaminating the contents with a contaminated outer surface of the bag, but bags that are also easy to load, stack, and palletize. These bags are typically formed using a pinch bottom whereby the commodity-holding pouch is formed from an inner plastic ply that is heat sealed at the pinch closure of the outer enclosing bag and open at the opposite end for receipt of a product to be packaged. Upon filling the bag to the desired amount, the inner plastic ply is heat sealed to close the open end and may remain attached or optionally be severed from the top end of the outer plies using a pair of beveled compression rollers. Applicants have recognized that additional problems can be encountered with this type of bag arrangement, however. For example, often the unfilled inner plastic bag in the standing position is much shorter in length than the enclosing outer paper bag. This can cause uneven or excessive pressures on the lower plastic seal creating a potential for seal failure or pinholing. Some attempts to solve this problem were made as seen in U.S. Pat. No. 5,281,027 by Thrall titled "Multiple Ply Bag with Detachable Inner Sealed Pouch for Packaging Products" which describes using a seamless inner heat sealable ply that is as long as the outer paper bag during the filling process and that is freely folded and fully detachable in a non-adhesive manner at the bottom end of the pinch bottom bag. Additionally, U.S. Pat. No. 5,553,943 by Cook et al. titled "Multiple Ply Plastic Line Bag with Satchel Bottom" describes using a seamless inner plastic pouch capable of heat sealing wherein the plastic pouch is foldably, non-adhesively and detachably arranged at the satchel bottom of the bag. The satchel bottom is formed by slitting, folding, and overlapping stepped paper plies adhesively bonded to form the satchel bottom and to loosely retain the pouch independently and away from the adhesive bond. Applicants have recognized that there is still a need, however, for alternative type vented bags and packaging that addresses problems associated with products sifting and insect infestation and yet is easy and cost effective to manufacture.

SUMMARY OF THE INVENTION

In view of the foregoing, an embodiment of the present invention advantageously provides a multiwall vented bag and associated methods that allow a vented bag to be easily constructed and yet substantially reduces the risk of filler material sifting from the bag and of insects infesting the bag through vents in the bag. An embodiment of the present invention also advantageously provides a multiwall vented bag that enhances stacking ability and yet allows air trapped in the bag to be readily vented therefrom. An embodiment of the present invention further advantageously provides end product packaging that is sealable and includes a vented assembly built onto and inner tube formed of plastic material that permits air release after the bag is packed and an open end of the bag and a plastic pouch have been sealed. An embodiment of the present invention also advantageously provides a multiwall vented bag of tubular form having a continuous unseamed tube body to enhance manufacturing and handling and to enhance reliability. Further embodiments of the present invention advantageously provide user friendly bags capable of holding products of varying weights, that are strong and durable, that provide consumers with a venting capability that will allow air release to accommodate the handling and stacking the bag for shipment, will reduce the possibility of product leakage or infestation, and will be cost effective and easy to manufacture.

More particularly, a multiwall bag according to an embodiment of the present invention is provided which includes an inner tube formed of a plastic material and having an open-end, a closed end positioned opposite the open end, an inner tube body extending between the open end and the closed end initially in an open position and adapted to receive filling material therethrough, and a plurality of spaced-apart inner vent openings formed in the inner tube body. The bag also includes a plastic strip overlying and adhering to a preselected region of the inner tube body and positioned to overlie the plurality of spaced-apart inner vent openings. The plastic strip extends substantially the entire longitudinal extent of tube body and includes a plurality of spaced-apart outer vent openings to allow air to pass from within the inner tube body, through the plurality of space-apart inner vent openings, and through the plurality of spaced-apart outer vent openings. The combination of the plastic strip and the preselected region of the inner tube body define a vent seal zone. The vent seal zone includes a channel space positioned between an inner surface of the plastic strip and an outer surface of the inner tube body. The channel space also allows air to flow therethrough and extends between the plurality of spaced-apart inner vent openings and the plurality of spaced-apart outer vent openings so that the plurality of spaced-apart inner vent openings and the plurality of spaced-apart outer vent openings are not aligned and thereby form a tortuous path to significantly reduce the risk of insect infestation and to significantly reduce product sifting when product is positioned in the bag. The bag further includes an outer tube positioned to substantially surround outer surfaces of the inner tube. The outer tube has a closed end region positioned closely adjacent the closed end of the inner tube, an open end region positioned closely adjacent the open end of the inner tube, positioned initially in an open position, and adapted to receive filling material therethrough, and an outer tube body extending between the open end region and the closed end region and overlying the plastic strip. The outer tube is formed of a plurality of layers of porous material to thereby allow air released from the vent seal zone to pass out of the bag through each of the plurality of layers of porous material.

Another embodiment of a multiwall vented bag is provided which includes an inner tube formed of a plastic material and having an open-end, a closed end positioned opposite the open end, an inner tube body extending between the open end and the closed end, and at least one vent opening formed in the inner tube body. The bag also includes a strip of material adhering to a preselected region of the inner tube body and positioned to lie adjacent the at least one vent opening of the inner tube body, e.g., underlying or overlying the preselected region of the inner tube body. The strip extends a preselected longitudinal extent of the inner tube body and includes at least one vent opening formed therein to allow air to pass from within the inner tube body, through both of the at least one vent opening of the inner tube body, and the at least one vent opening of the strip. The combination of the strip and the preselected region of the inner tube body define a vent seal zone. The bag further includes an outer tube positioned to substantially surround outer surfaces of the inner tube. The outer tube has a closed end region positioned closely adjacent the closed end of the inner tube, an open end region positioned closely adjacent the open end of the inner tube, positioned initially in an open position, and adapted to receive filling material therethrough, and an outer tube body extending between the open end region and the closed end region and overlying the inner tube body and the strip. The outer tube is formed of a porous material to thereby allow air released from the vent seal zone to pass out of the bag through the porous material of the outer tube.

The present invention also advantageously provides an end product packaging bag according to an embodiment thereof and includes a tube formed of at least one ply of plastic material and having an open-end, a closed end positioned opposite the open end, a tube body extending between the open end and the closed end, and at least one vent opening, e.g., preferably a plurality of vent openings, formed in the tube body. The tube is adapted to be sealed to closure at its opposite ends. The bag also includes a plastic strip positioned adjacent and attached to a preselected region of the tube body including the at least one vent opening of the tube. The plastic strip also includes at least one vent opening, e.g., also preferably a plurality of vent openings, and is positioned to allow air to pass from within the inner tube body, through both the at least one vent opening of the tube body and the at least one vent opening of the plastic strip. The combination of the plastic strip and the preselected region of the tube body define a vent seal zone positioned to permit air release after the bag has been filled with filler material and the open end of the bag has been sealed. The vent seal zone also can include a channel space positioned between a surface of the plastic strip and a surface of the tube body. The channel space allows air to flow therethrough and extends between the at least one vent opening of the tube body and the at least one vent opening of the plastic strip so that the at least one vent opening of the tube and the at least one vent opening of the strip are not aligned and thereby form a tortuous path to significantly reduce the risk of insect infestation and to significantly reduce product sifting when product is positioned in the bag.

The present invention still also advantageously provides an apparatus for forming a vented bag. The apparatus includes a supply of a tube of at least one ply of plastic material, at least a pair of spaced-apart rollers each positioned to receive the tube, a plate member positioned in the tube between the at least a pair of space-apart rollers, and a perforator roll rotatably positioned adjacent a first outer surface of the plate member so that the plate member operates as a stop for the perforator roll to prevent perforation of a second opposing outer surface of the tube and yet allowing perforation of the first outer surface of the tube to form a plurality of spaced apart vent openings in the first outer surface of the tube when the perforator roll rotates adjacent the first outer surface of the tube. The tube of at least one ply of plastic material can extend in a substantially horizontal orientation between the at least one pair of spaced-apart rollers during travel in a preselected manufacturing direction, and the perforator roll can overlie the plate member between the at least one pair of spaced-apart rollers and overlie and contact a substantially horizontal extending first outer surface of the tube to form the plurality of spaced-apart vent openings therein. The plate member is positioned to be suspended within the tube between the at least one pair of spaced-apart rollers to thereby define a floating plate. The floating plate travels within the tube between the at least one pair of spaced-apart rollers in a suspended position when the tube is being perforated with the perforator roll and when the tube travels between the at least one pair of spaced-apart rollers.

The apparatus can also include the perforator roll being a first perforator roll, and the apparatus can further have a separate supply of plastic strip of material, a second perforator roll rotatably positioned to contact the plastic strip to form a plurality of spaced-apart vent openings in the plastic strip, and an adhering device positioned adjacent the plastic strip and the tube in a preselected region to adhere the plastic strip material to the tube to thereby form a vented seal zone having a channel space formed between surfaces of the plastic strip and the tube so that the combination of the plurality of vent openings in the tube and the plurality of vent openings in the plastic strip are positioned to not align so as to create a tortuous path therebetween. The at least one ply of plastic material of the tube can be formed of a continuous seamless, tubular, plastic film. The tube can define an inner tube, and the apparatus can further have a supply of porous material and an attaching device positioned to attach the inner tube to inner surfaces of an outer tube formed of the porous material to substantially surround the inner tube. A separator can then separate a plurality of preselected portions of the attached inner and outer tubes. The preselected portions can be shaped, formed, and closed on at least one end of the separated plurality of preselected portions to thereby define a plurality of separate multiwall bags.

The present invention also includes methods of forming and using a bag. For example, according to an embodiment of the present invention, a method of forming a vented bag includes perforating a tube of at least one ply of plastic material to form a plurality of spaced apart vent openings in the tube, perforating a separate plastic strip of material to form a plurality of spaced apart vent openings in the plastic strip, and adhering the plastic strip adjacent the tube in a preselected region to thereby form a vented seal zone having a channel space formed between surfaces of the plastic strip and the tube so that the combination of the plurality of vent openings in the tube and the plurality of vent openings in the plastic strip are positioned to not align so as to create a tortuous path to significantly reduce product sifting and insect infestation when product is positioned within the tube and so that air within the tube travels through both of the plurality of vent openings in the tube and the plurality of vent openings in the plastic strip.

Another method of forming a vented bag includes positioning a plate member within a tube of at least one ply of plastic material and rotatingly perforating the tube with a perforator roll positioned adjacent a first outer surface of the plate member so that the plate member operates as a stop for the perforator roll to prevent perforation of a second opposing outer surface of the tube and yet allowing perforation of the first outer surface of the tube to form a plurality of spaced apart vent openings in the first outer surface of the tube. The method can also include perforating a separate plastic strip of material to form a plurality of spaced apart vent openings in the plastic strip and adhering the plastic strip adjacent the tube in a preselected region to thereby form a vented seal zone having a channel space formed between surfaces of the plastic strip and the tube so that the combination of the plurality of vent openings in the tube and the plurality of vent openings in the plastic strip are positioned to not align so as to create a tortuous path to reduce product sifting and insect infestation when product is positioned within the tube and so that air within the tube travels through both of the plurality of vent openings in the tube and the plurality of vent openings in the plastic strip.

Another example of an embodiment of a method of using a multiwall bag having a vent seal zone associated therewith includes filling first and second multiwall bags with filler material. Each of the first and second multiwall bags have an inner plastic tube, a vent seal zone formed by a plastic strip attached to a preselected region of the inner plastic tube, and an outer tube formed of a plurality of layers of porous material attached to and substantially surrounding the inner tube. The inner plastic tube has a plurality of spaced-apart vent openings and the plastic strip includes a plurality of spaced-apart vent openings not aligned with the plurality of space-apart vent openings of the inner plastic tube so as to create a tortuous path therebetween. The vent seal zone also includes a channel space positioned between a surface of the plastic strip and a surface of the inner tube body. The method also includes closing each of an open end of the first and second multiwall bags after filler material is filled therein and stacking the second multiwall bag to overlie and contact the first multiwall bag so that pressure from weight of the second multiwall bag increases the air flow from the inner tube of the first multiwall bag, through both the plurality of vent openings in the inner tube and the plurality of openings in the plastic strip, and through the porous material of the outer tube to atmosphere.

Yet another example of a method of using a bag having a vent seal zone associated therewith according to an embodiment of the present invention includes filling a bag with filler material. The bag has a plastic tube which includes a closed end, an open end through which filler material flows during filling, and a tube body extending between the open end and the open end. The bag also has a vent seal zone defined by a plastic strip attached to a preselected region of the plastic tube. The plastic tube has a plurality of spaced-apart vent openings and the plastic strip includes a plurality of spaced-apart vent openings. The vent seal zone also includes a channel space positioned between a surface of the plastic strip and a surface of the tube body. The method also includes heat sealing the open end of the tube body and an upper end of the channel space positioned adjacent the open end of the tube body after filler material is filled therein to a selected level to thereby seal the open end of the tube body and the upper end of the channel space. The method can also include compressing the bag so that trapped gas or air flows from within the tube body, through the innermost plurality of spaced apart vent openings of the vent seal zone, through the channel space, along the tortuous path, through the outermost plurality of spaced apart vent openings of the vent seal zone.

A multiwall vented bag having a vent seal zone for packaging end products according to an embodiment of the present invention can be used for any type of product, but preferably product types that allow stacking to take advantage of the performance characteristics of a multiwall bag. Such product uses include bags for various food items including dairy products, powdered products, pet food products, rice or pasta products, and other uses as will be understood by one skilled in the art and are to be considered within the scope of this invention.

BRIEF DESCRIPTION OF THE DRAWINGS

So that the manner in which the features and advantages of the invention, as well as others which will become apparent, may be understood in more detail, more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Figure 1:
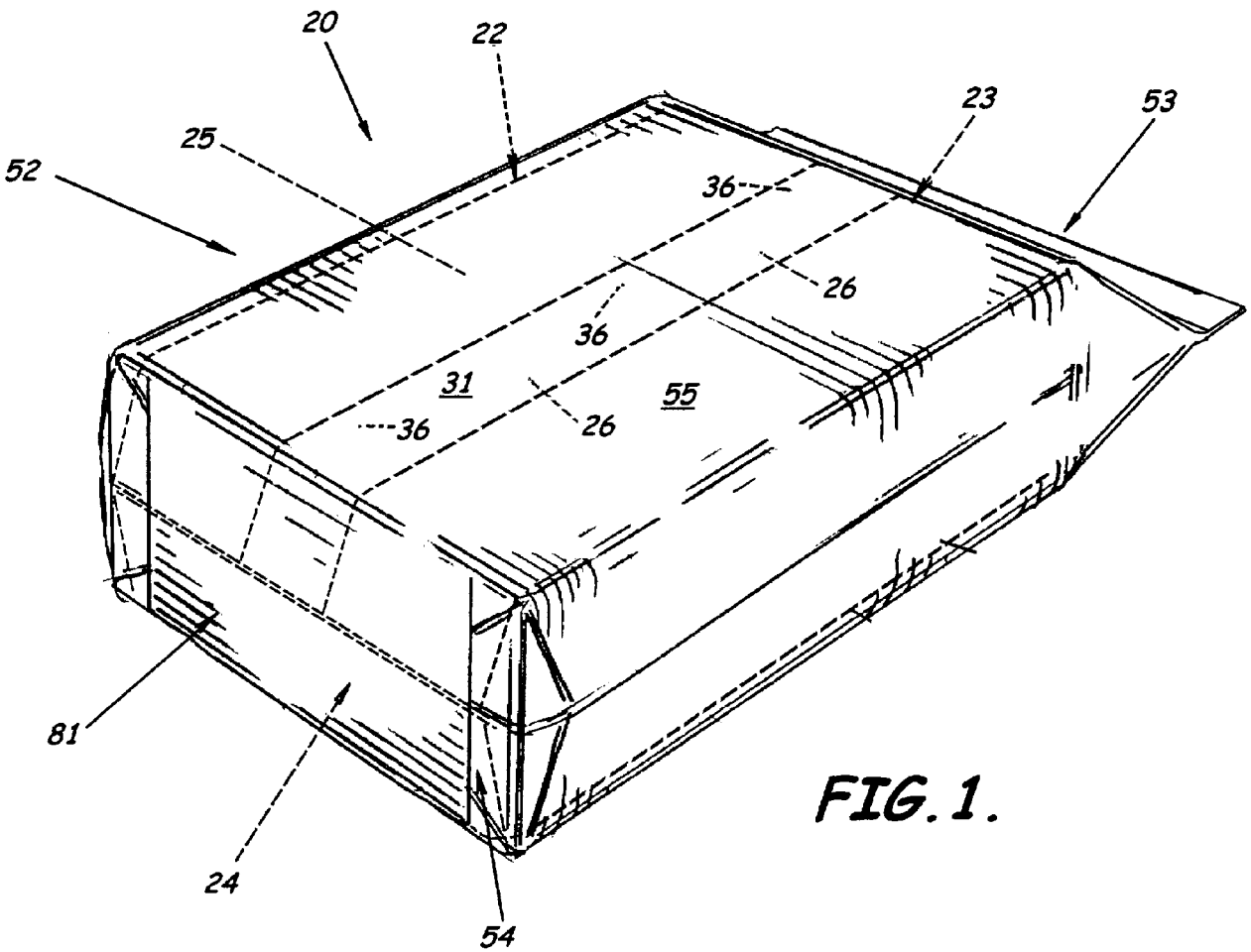
FIG. 1 is a perspective view of a multiwall vented bag according to an embodiment of the present invention.

The present invention will now be described more fully hereinafter with reference to the accompanying drawings, which illustrate embodiments of the invention. This invention may, however, be embodied in many different forms and should not be construed as limited to the illustrate embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

As illustrated in FIGS. 1–17, embodiments of the present invention advantageously provide a multiwall bag 20, e.g., a plurality of overlying layers or plies of material. The bag includes an inner tube 22 formed of a plastic material, e.g., such as supplied from a roll of plastic tube material 27 (see FIGS. 1–2 and 6). In a preferred embodiment of the bag 20, the plastic material includes a seamless, tubular plastic film. "Seamless" is used herein as lacking or being devoid of at least any longitudinal seam, and more preferably no lateral seams other than end closures as well, that is, manufactured as a continuous tubular plastic film (see FIG. 6) and not a rectangular sheet which is heat or otherwise sealed along a longitudinal axis between ends thereof or a horizontal axis transverse to ends thereof. The inner tube 22 has an open-end 23, a closed end 24 positioned opposite the open end 23, and an inner tube body 25 extending between the open end 23 and the closed end 24 (see FIGS. 1 and 17). The inner tube 22 also includes at least one inner vent opening 26, and more preferably a plurality of vent opening 26, formed in the inner tube body 25 (see FIG. 1).

Figure 2:
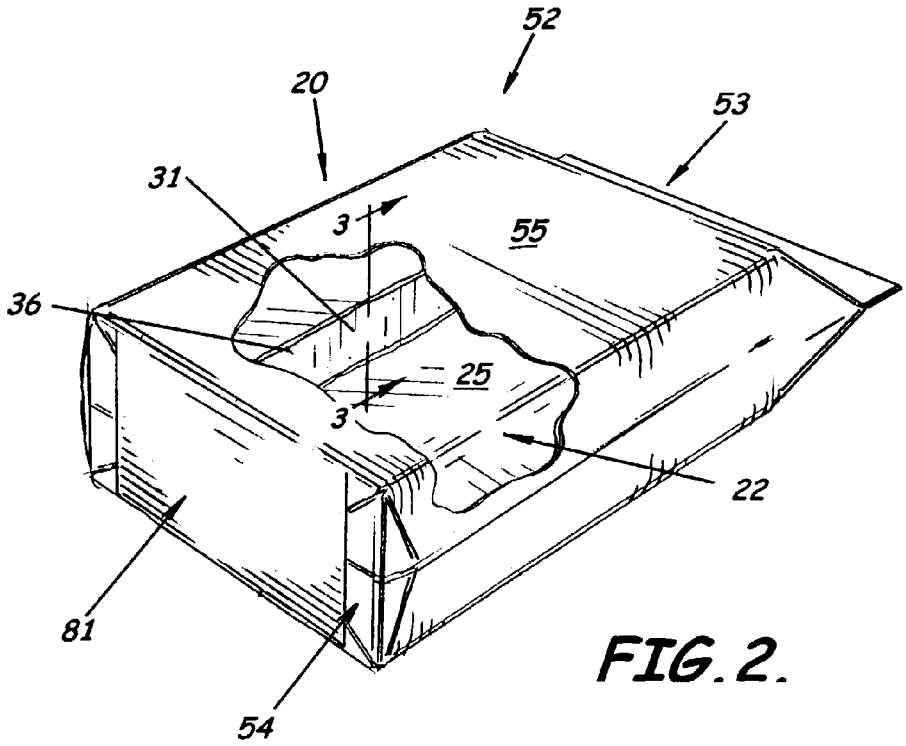
FIG. 2 is perspective view of a multiwall vented bag having portions thereof broken away for clarity according to an embodiment of the present invention.
Figure 3:
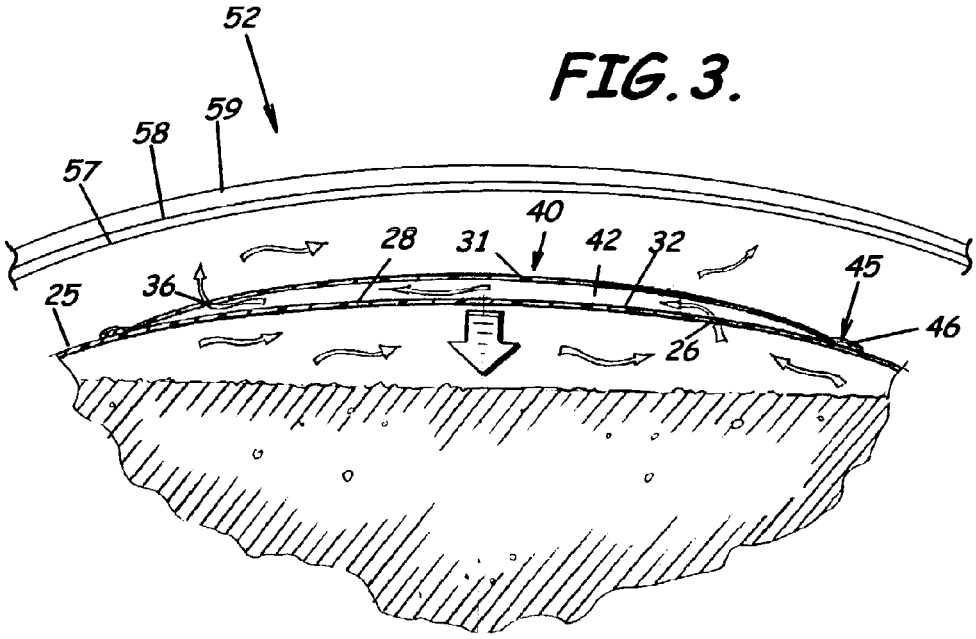
FIG. 3 is an enlarged fragmentary sectional view of a multiwall vented bag taken along line 3—3 of FIG. 2 according to an embodiment of the present invention.
Figure 4:
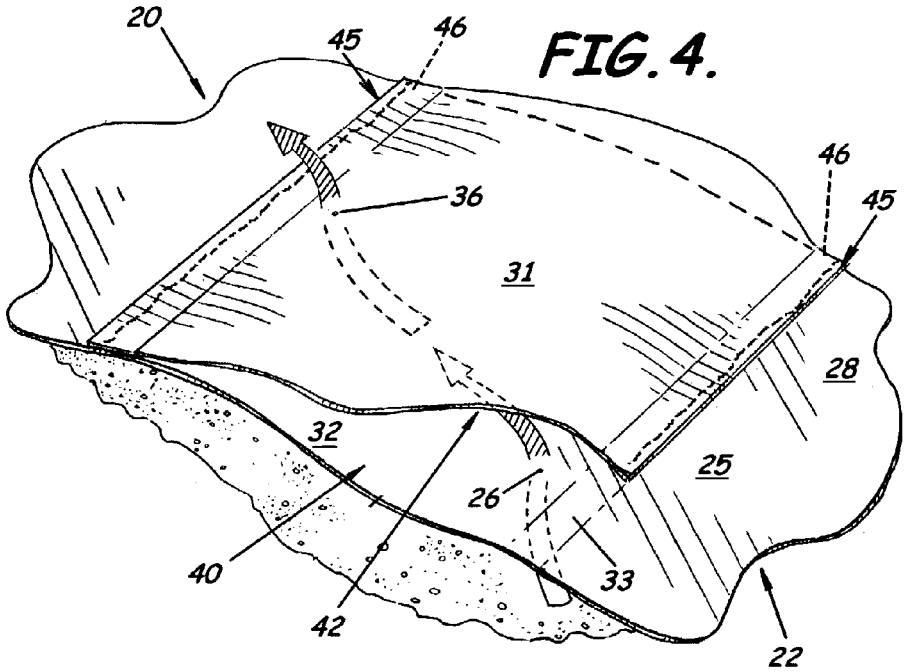
FIG. 4 is an enlarged fragmentary perspective view of a multiwall vented bag showing air flow according to an embodiment of the present invention.
Figure 5:
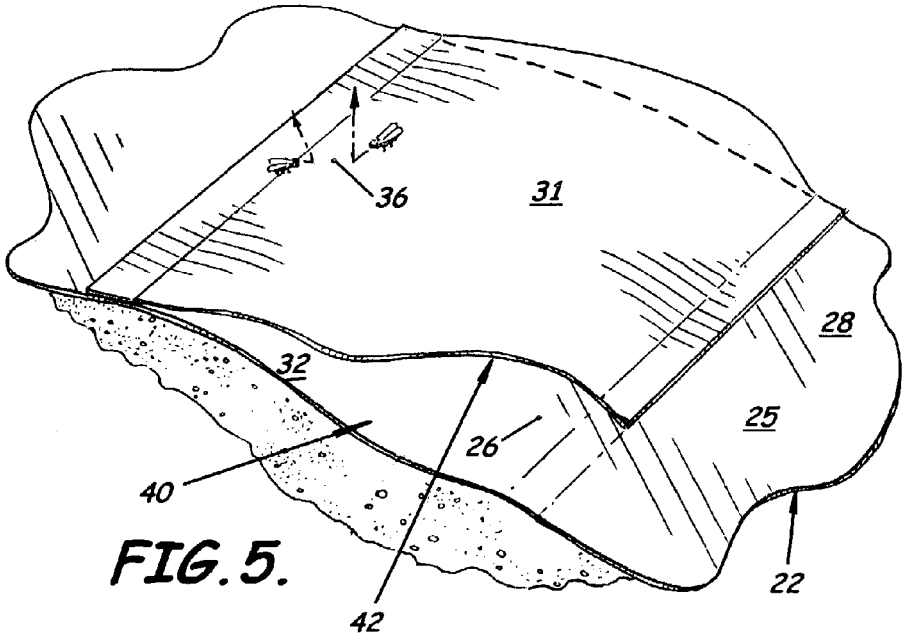
FIG. 5 is an enlarged fragmentary perspective view of a multiwall vented bag showing reduction in insect infestation according to an embodiment of the present invention.
Figure 6:
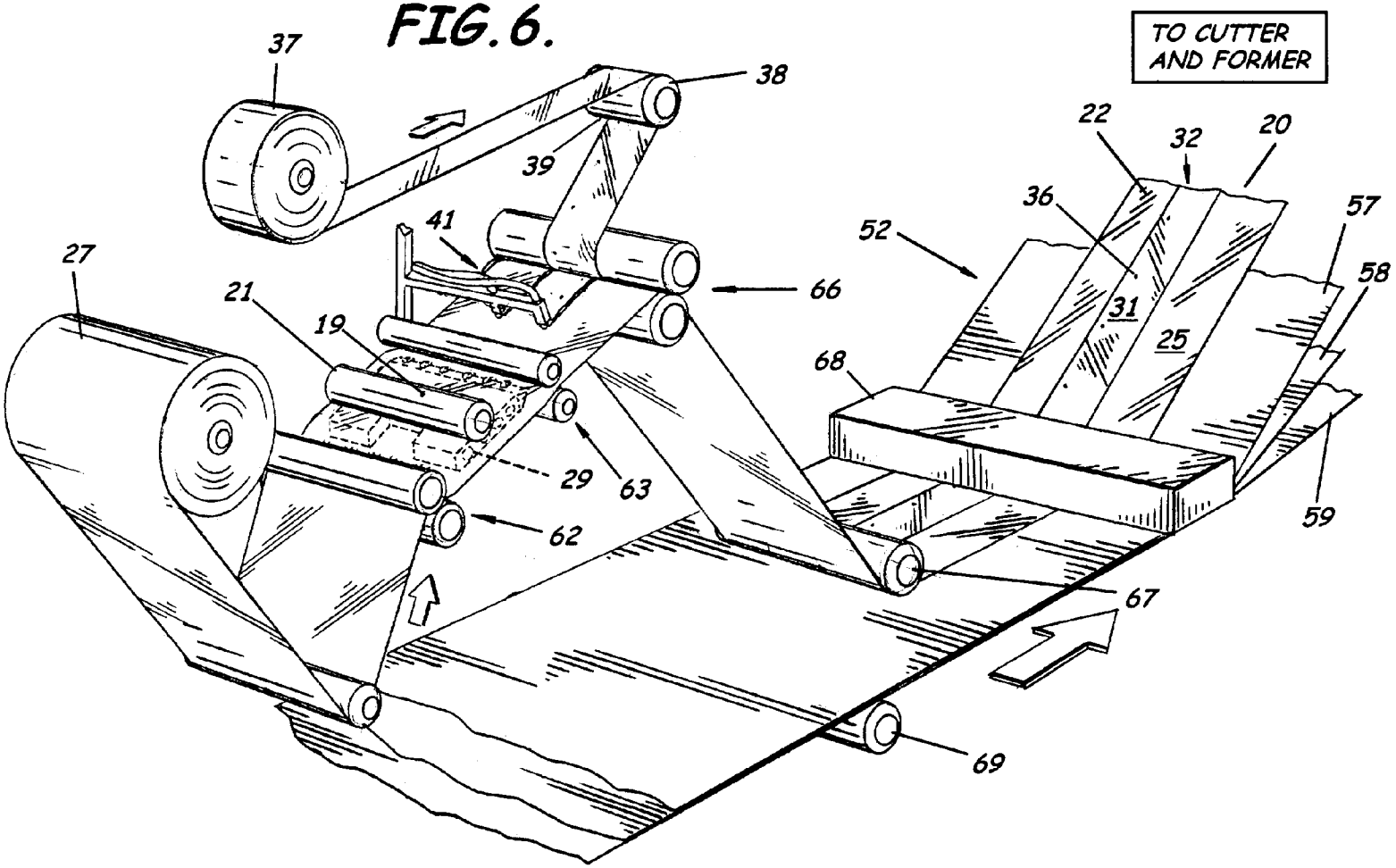
FIG. 6 is a perspective view of a bag forming apparatus to form a multiwall vented bag according to an embodiment of the present invention.

As perhaps best shown in FIGS. 2–6, the bag 20 also includes a plastic strip 31 overlying and adhering to a preselected region 32 of the inner tube body 25 and positioned to overlie the at least one inner vent opening 26. As shown in FIGS. 1–2, and 6, in an embodiment of the bag 20, the plastic strip 31 extends substantially the entire longitudinal extent of the tube body 25. Other embodiments of the positioning of the plastic strip 31, e.g., lateral, transverse, arcuate, shaped, or pattern, adjacent the tube body 25 can be used as well according to the present invention. Although the positioning of the plastic strip 31 has some distinct advantages with respect to ease of manufacturing and enhance performance characteristics of the bag 20, e.g., quicker and more even venting of air or gas from the inner tube 22, this feature is not of necessity in order to still comply with the scope and spirit of the invention. As shown in FIG. 4, the plastic strip 31 includes at least one outer vent opening 36, and preferably a plurality of vent openings 36, to allow air to pass from within the inner tube body 25, through the at least one inner vent opening 26, and through the at least one outer vent opening 36. The combination of the plastic strip 31 and the preselected region 32 of the inner tube body 25 define a vent seal zone 40. Note, the term "air" refers to any gaseous substance as used herein. Also, although the plastic strip 31 is illustrated and described by way of example as positioned to overlie an outer surface of the inner tube body 25, the invention also contemplates positioning the plastic strip 31 along an inner surface of the tube body 25 as well.

In an embodiment of a bag 20, as shown in FIGS. 1 and 2, the at least one inner vent opening 26 includes a plurality of vent openings 26 positioned in a space-apart relation such as along the longitudinal extent of the tube body. The plurality of vent openings each can be one opening, e.g., a pinhole, as shown, group or cluster of openings spaced-apart, or a preselected pattern, e.g., rows and columns, clusters, stars arrangements, and rectangular arrangements, if desired. Also, the at least one outer vent opening 36 can include a plurality of outer vent openings 36 positioned in a spaced-apart relation along the longitudinal extend of the plastic strip as well. The plurality of outer vent openings 36 are positioned spaced apart from and do not align with, e.g., directly overlie, the plurality of inner vent openings 26. Instead, a plurality of individual holes such as the pin holes shown, openings, slits or patterns, groups, or clusters of vent openings 26 are positioned at different locations along the longitudinal extent of the inner tube body than the locations of individual holes such as the pinholes shown, openings, slits or patterns, groups, or clusters of vent openings 36 formed in the overlying plastic strip 31.

Figure 7:
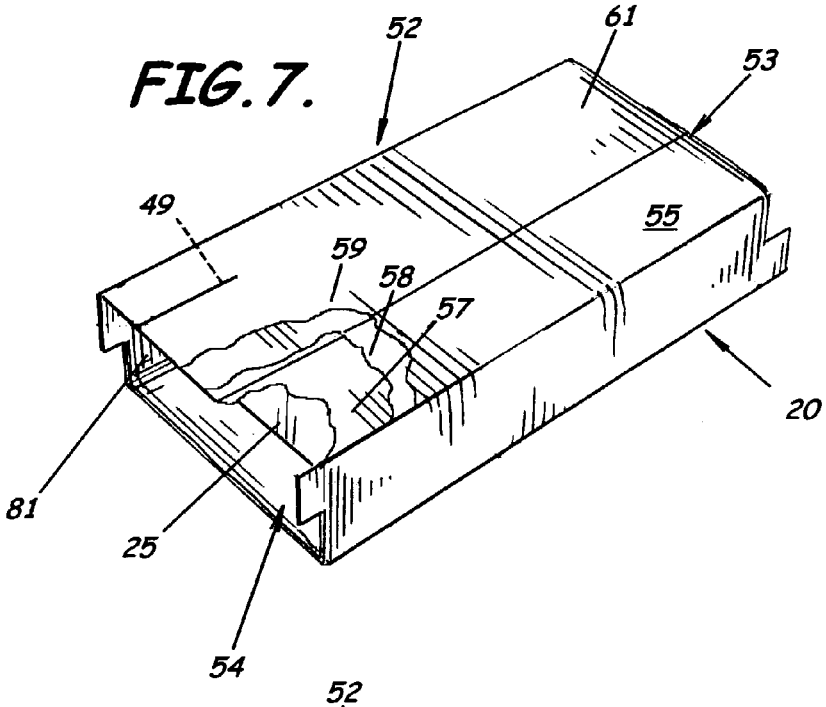
FIG. 7 is a perspective view of the outer tube of a multiwall vented bag having portions thereof broken away for clarity and showing paper plies of an outer tube slit and in a stepped form according to an embodiment of the present invention.

As shown in FIGS. 1–2 and 7, the bag 20 includes an outer tube 52 positioned to substantially surround outer surfaces of the inner tube 22. The outer tube 52 has a closed end region 54 and an open end region 53 being initially in an open position and adapted to receive filling material therethrough. The outer tube 52 also includes an outer tube body 55 extending between the open end region 53 and the closed end region 54 and overlying the plastic strip 31. As shown in FIGS. 2–3, 6–7, 9, and 15–16, the outer tube 52 is formed of a plurality of layers of a porous material 57, 58, 59, e.g., paper or paper ply such as in a range of two to six layers, to thereby allow air released from the vent seal zone 40 to exit from, travel from, flow, or pass out of the bag 20 through the porous material 57, 58, 59. In an embodiment of a bag 20, overlapping edges of the multiple plies 57, 58, 59 of the nonporous material are adhesively bonded to form the tube 52. All of this forming, for example, can be done by a tuber or tube former as understood by those skilled in the art.

In an embodiment of a bag 20, as shown in FIGS. 1 and 6, the plastic material 27 forming the inner tube 22 does not include a longitudinal seam used to form a sheet of plastic material into a tube. In this embodiment, the plastic material 27 is formed into a continuous, unseamed or seamless, tubular film of plastic, which forms a continuous plastic tube 22. In an alternative embodiment, however, forming the inner tube 22 by heat or otherwise sealing the longitudinal edges of a flat sheet or web, may be accomplished in the bag making process to create a tube 22, but with a longitudinal seam. As shown in FIGS. 3–6, the strip 31 is formed of a plastic material 37 overlays a preselected region 32 of the inner tube body 25 and is positioned to overlie the at least one inner vent opening 26. The vent seal zone 40 includes a channel space 42 positioned between a surface, e.g., an inner surface 33, of the plastic strip 31 and a surface, e.g., an outer surface 28, of the inner tube body 25. For ease of manufacturing and to enhance air flow, the channel space 42 can advantageously be unobstructed, but having baffles or other obstructions which allow air or gas to flow between a vent opening in the tube body and a vent opening in the strip can also be used as well according to the present invention and still be a channel space as will be understood by those skilled in the art. If the channel space 42 is unobstructed, then stacking, compressibility, and formation of the position or location of vent opening can be enhanced or made easier as well.

The channel space 42 of the vent seal zone 40 is substantially elongate and extends substantially the length of the inner tube body 25 between the open end 23 and the closed end 24 thereof. The plastic strip 31 includes at least one perforation, slit, hole, or piercing forming the at least one outer vent opening 36, e.g., formed by a perforating roll 38, to allow air to either enter or exit the channel space 42 created between the inner tube 22 and the plastic strip 31, depending on whether the strip 31 is configured on the inside or outside of the inner tube. The inner tube 22 also includes at least one perforation, slit, hole, or piercing forming the at least one inner vent opening 26, e.g., formed by a perforating roll 21 and a floating plate or roll stop member 29, to allow air to either enter or exit the channel space 42 created between the inner tube 22 and the plastic strip 31. The floating plate or roll member 29 can advantageously be positioned inside the tube 22, e.g., between respective inner surface of faces or walls of the continuous tube material prior to perforation and float in a trapped or enclosed region as the perforating roll 21 rotates along an outer surface of the tube 22. The vent openings or holes 26, 36, for example, advantageously can be as small as the size of pinholes. Advantageously, the channel space 42 extends between at least one inner vent opening 26 and at least one outer vent opening 36 so that the at least one inner vent opening 26 and the at least one outer vent opening 36 are not aligned, e.g., do not directly overlie or underlie, and thereby form a tortuous path. "Tortuous path" is used herein as a path other than a path parallel to an axis directly perpendicular to the longitudinal plain of the plastic material strip 31. This path helps to significantly reduce product sifting and insect infestation. Also, as illustrated, have both lateral and longitudinal spacing between vent openings 36 in the plastic strip 31 and vent openings 26 in the inner tube advantageously makes even further reduces the risk of product sifting and insect infestation and yet still allows air or gas to be readily released from the inner tube. Additionally, the preselected spacing between individual openings, e.g., holes as shown or clusters holes, can enhance ease of manufacturing and enhances air flow from the channel without greatly increasing the risk of product sifting or insect infestation. For example, selecting a different number or a spacing between individual openings, e.g., individual holes 26, 36 or groups of holes, such as one hole every three inches, six inches, or eight inches, advantageously can be used depending on the desired air flow from the inner tube body in relation to the length or size of the bag 20.

In an embodiment, as shown by FIG. 4, the bag 20 can further include a pair of spaced-apart longitudinal adhesive regions 45 positioned between outer surfaces of the inner tube body 25 and a pair of elongate inner surface regions of the plastic strip 31 so that the channel space 42 extends between the pair of spaced-apart longitudinal adhesive regions 45. Using the adhesive regions 45 enhances ease of manufacturing and forming the internal bag, but other adhering techniques or processes such as scaling, bonding, or molding as understood by those skilled in the art can be used as well according to the present invention. The channel space 42 thus allows air to flow therethrough. The channel space 42 is formed by the combination of the inner tube 22 and plastic strip 31. In this way, as shown in FIGS. 3 and 4, and in the preferred configuration of the channel space 42, air flows from within the inner tube body 25, and through the at least one inner vent opening 26, a plurality of spaced-apart inner vent openings 26 in the preferred embodiment. The air then flows through the channel space 42 extending between the pair of spaced-apart longitudinal adhesive regions 45, along the tortuous path, and through the at least one outer vent opening 36, a plurality of spaced-apart outer vent openings 36 in the preferred embodiment (see, e.g., FIG. 3). The air then flows into an innermost layer 57 of the plurality of layers 57, 58, 59 of porous material, and through at least one overlying layer, e.g., 58, 59, of the plurality of layers 57, 58, 59 of porous material. Note that although the preferred embodiment includes a plurality of layers of porous material 57, only one layer is required to comply with the spirit of the present invention. In an embodiment of the bag 20, two longitudinal spaced beads of adhesive 46 are used to adhesively secure the plastic strip 31 to the selected region 32 of the inner tube body 25. The seal along the plastic strip 31 can be heat responsive beads of adhesive 46 or other non-heat responsive seals as understood by those skilled in the art.

An embodiment of the present invention advantageously provides a multiwall bag 20 having an outer tube 52 which allows air released from the channel space 42 in the vented seal zone 40 to pass out of the bag 20 via the porosity of the outer tube material. In an embodiment, the at least one innermost layer 57 of porous material of the outer tube 52 is perforated. The perforations or auxiliary perforations 49, e.g., in addition to the more natural pores of the porous material, aids the expulsion of trapped air gathered between the inner tube 22 and the outer tube 52. These perforations in the innermost layer 57, for example, can be only on one front or back side of the bag 20 and also can be positioned in the closed end region 54, the open end region 53, or both. By positioning these perforations or slits in the closed end region 54, for example, manufacturing and forming the bag 20 can be enhanced such as when forming a satchel bottom 81 as understood by those skilled in the art and still enhance air passing from the inner tube 22 through the outer tube 52.

Figure 8:
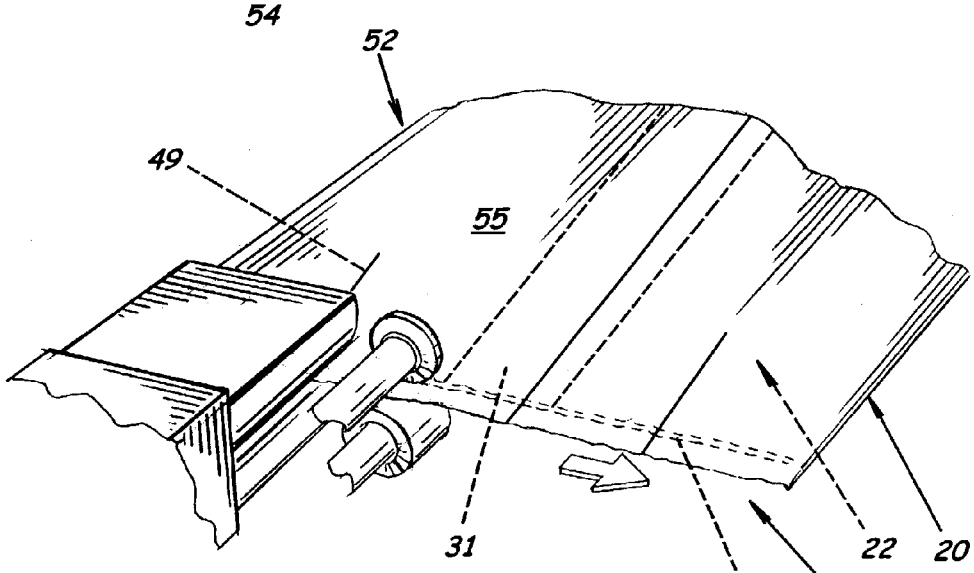
FIG. 8 is a fragmentary perspective view of a closed end region of a multiwall vented bag in the process of being heat sealed according to an embodiment of the present invention.
Figure 9:
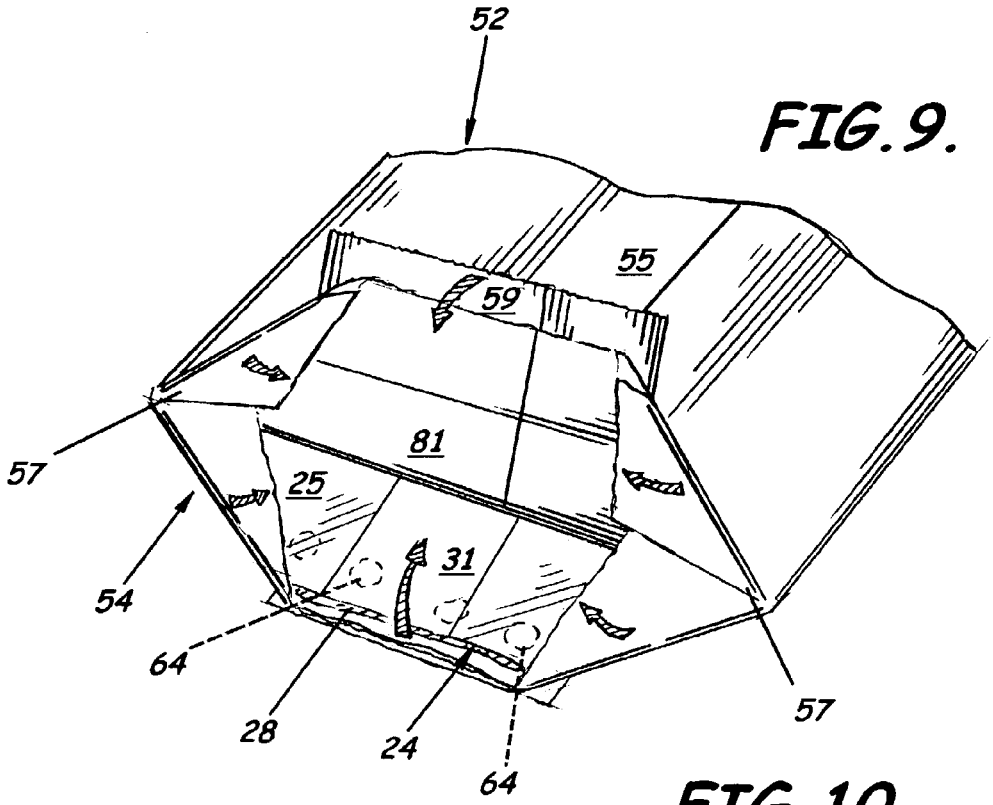
FIG. 9 is a fragmentary perspective view of a closed end region of a multiwall vented bag having a satchel bottom according to an embodiment of the present invention.

In an embodiment of the bag 20, as shown by FIGS. 8–9, the closed end 24 of the inner tube 22 is heat-sealed during the bag forming, manufacturing, or making process. The heat seal seals or closes both the closed end 24 of the inner tube 22 and the lower end of the channel space 42 adjacent the closed end 24. The multiwall bag 20 can advantageously have the closed end 24 of the inner tube 22 detachably adhered to the closed end region 54 of an outer tube 52 so that the inner tube 22 remains adhered to the outer tube 52 during filling of the bag 20 with filling material. The closed end 24, for example, can be adhered or bonded using individual beads 64 of adhesive material, as well known to those skilled in the art, preferably using a plurality of beads 64 of adhesive material or similar methodology, on one-half or one side inner surface, e.g., front or back, of the outer tube 52, or one side of the outer surface 28 of the inner tube 22. This advantageously allows the inner tube 22 to be readily detach or separated from to the inner ply 57 of the outer tube 52 without damage to the inner tube 22, e.g., no tearing, ripping, or puncturing, when the inner tube 22 is filled with product or filler material (see, e.g., FIG. 17). Although the bonding may be accomplished on both sides of an inner ply of the outer tube 22, bonding only on one side is preferred as it allows for ease of folding the inner tube 22 with the outer tube 52 and provides the user of the bag 20 with the ability to selectively remove the inner tube 22 from the outer tube 52 when the inner tube 22 has filling material positioned therein.

Figure 10:
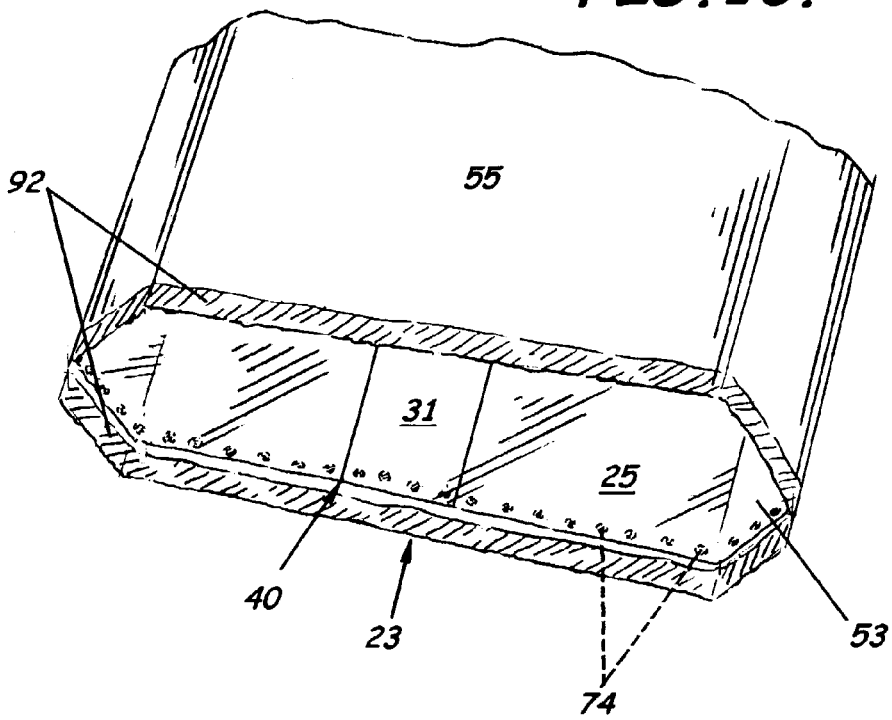
FIG. 10 is a fragmentary perspective view of an open end region of a multiwall vented bag showing an inner tube connection to an outer tube at the open end region according to an embodiment of the present invention.

Also, in an embodiment of a multiwall vented bag 20, as shown in FIG. 10, the inner tube 22 is correspondingly bonded at its circumference adjacent the open end 23 in order to best secure the inner tube 22 inside the outer tube 52. This is accomplished by individual beads 74 of adhesive, though other methodologies are of course possible, including the use of an adhesive strip. This adhesive attachment or beads along the open end region of the outer tube 52 allows the inner tube 22 to be readily sealed and separated from inner surfaces of the outer tube 52 so that the inner tube 22 having filling material therein then becomes an inner pouch or bag having a seal at the upper end thereof of both the inner tube 22 and the channel space 42.

As shown by FIGS. 7 and 9, an embodiment of a multiwall vented bag 20 also advantageously provides an outer tube 52, which includes a front region and a back region opposite the front region out of the outer tube body 55. As understood by those skilled in the art, the closed end region 54 of the outer tube 22 can advantageously include a satchel bottom 81. In an embodiment of the bag 20, the outer tube 52 can be cut during the bag manufacturing process using perforator knives as understood by those skilled in the art that allow a multiwall paper satchel bottom 81 to be folded onto the inner tube 22 to retain the closed end 24 of the inner tube 22. The satchel bottom 81 is basically formed by slitting, cutting, or perforating the paper or porous material. In an embodiment of a bag 20, this can be accomplished along a single longitudinal axis on a selected portion of the tube 52. For example, a series of slits 49 can be cut through all plies of the outer tube 52. Two parallel slits 49 are made adjacent the closed end 54 and on a first side of the outer tube 52 and two parallel slits 49 are correspondingly made adjacent the closed end 54 and on a second side thereof. The depth and spacing can be accomplished to optimize the lateral distances between the slits 49 on sequential plies as understood by those skilled in the art. As shown in FIGS. 6–7, in an embodiment of a bag 20, the outer tube 52 can have a stepped arrangement on the layers 57, 58, 59 of porous material on a selected side, e.g., front or back region, of the closed-end region 54 and a correspondingly yet opposite arrangement on the open end region 53. Alternative embodiments, however, can also provide the customer with a flush cut top, patch bottom, or pinch bottom. In the preferred embodiment, the porous material is paper ply stepped longitudinally and oppositely on the front and back sides in order to provide an easier folding capability on the closed end region 54 and a smoother contour of an upper seal with the open end region 53, especially when an embodiment calls for the open end region 53 to include a pinch step closure pattern. In an embodiment of a bag 20 as shown in FIGS. 8, 12–14, the bag further can include a pre-applied hot melt 92 or other adhesive methodology applied to the open end region 53 of the outer tube 52 that can be reactivated by the user after the bag 20 has been filled with product (see, e.g., FIG. 14). Also as part of the open end sealing process, in an embodiment, the heat sealing of the open end 23 of the inner tube 22 can advantageously correspondingly seal the channel space 42 adjacent the open end 23 of the inner tube 22. Although only heat sealing methodology has been elaborated on regarding sealing the open and closed ends and ends of the channel space, other sealing methodologies, as desired, can be used and still comply with the spirit of the various embodiments of the present invention.

As illustrated in FIGS. 3–6, 8, 10, and 17, an embodiment of the present invention advantageously also provides an end product packaging bag, e.g., formed by the inner tube 22 or pouch. The bag includes a tube 22 formed of at least one ply of plastic or non-porous material. The plastic material advantageously can include a seamless, tubular plastic film 27. The tube 22 has an open-end 23, a closed end 24 positioned opposite the open end 23, a tube body 25 extending between the open end 23 and the closed end 24, and at least one vent opening 26 formed in the tube body 25. As shown in FIG. 6, the bag also includes a vent seal zone 40, e.g., a vented assembly as will be understood by those skilled in the art. The vent seal zone 40 includes a plastic or otherwise non-porous material strip 31 overlying and adhering to a preselected region 32 of the tube body 22. The strip 31 is positioned to overlie, or underlie in other embodiments, the at least one vent opening 26 of the tube 22. The plastic or otherwise non-porous material strip 31 also includes at least one vent opening 36. This combination of the plastic or otherwise non-porous material strip 31 and the preselected region 32 of the tube body 25 defines the vent seal zone 40 as illustrated and described herein.

As shown in FIG. 4, the vent seal zone 40 includes a channel space 42 positioned between an inner surface 33 of the plastic or otherwise non-porous material strip 31 and a surface of the tube body 25. This channel space 42 is preferably unobstructed in any significant manner so that the channel space 42 readily also allows air to flow therethrough and remains substantially flat during stacking of bags 20 or pouches when filled with filler material or product. The channel space 42 extends between the at least one vent opening 26 of the tube 22 and the at least one vent opening 36 of the plastic or otherwise non-porous material strip 31 so that the at least one vent openings 26 of the tube 22 and the at least one vent opening 36 of the strip 31 are not aligned and thereby form a tortuous path to reduce the risk of insect infestation and to reduce product sifting when product is positioned in the bag. In an embodiment of the bag, the channel space 42 of the vent seal zone 40 is substantially elongate and extends substantially the length of the inner tube body 25 between the open end 23 and the closed end 24 thereof. The plastic strip 31 includes at least one perforation, slit, hole, or piercing forming a vent opening 36 to allow air to either enter or exit the channel space 42 created between the tube 22 and the plastic strip 31, depending on whether the strip is configured on the inside 29 or outside 28 of the tube 22. The tube 22 also includes at least one perforation, slit, hole, or piercing forming a vent opening 26 to allow air to either enter or exit the channel space 42 created between the tube 22 and the plastic strip 31. The vent openings or holes, 26, 36 can be as small as the size of pinholes, for example. The at least one vent opening 36 of the plastic or otherwise non-porous material strip 31 and the tube 22 advantageously can be provided by a plurality of spaced-apart vent openings 26, 36 positioned in a preselected spaced relationship along the longitudinal extent of the tube 22 and the strip 31. The plurality of vent openings 36 of the strip 31 are positioned spaced apart from and do not directly overlie the plurality of vent openings 26 of the tube 22 as illustrated and described herein.

As shown in FIGS. 4, 6 and 8, the plastic or otherwise nonporous material forming the tube 22 advantageously does not include a longitudinal seam used to form a sheet of plastic or non-porous material into a tube 22. In this embodiment of a bag, the plastic or non-porous material 27 is formed from a continuous, unseamed or seamless, tubular, film of plastic, which forms a continuous plastic tube body 25. In an alternative embodiment, a tube 22 having a longitudinal seam may be used. The tube 22 may be formed by heat or otherwise sealing the longitudinal edges of a flat sheet or web to create a tube, albeit with a longitudinal seam.

Figure 17:
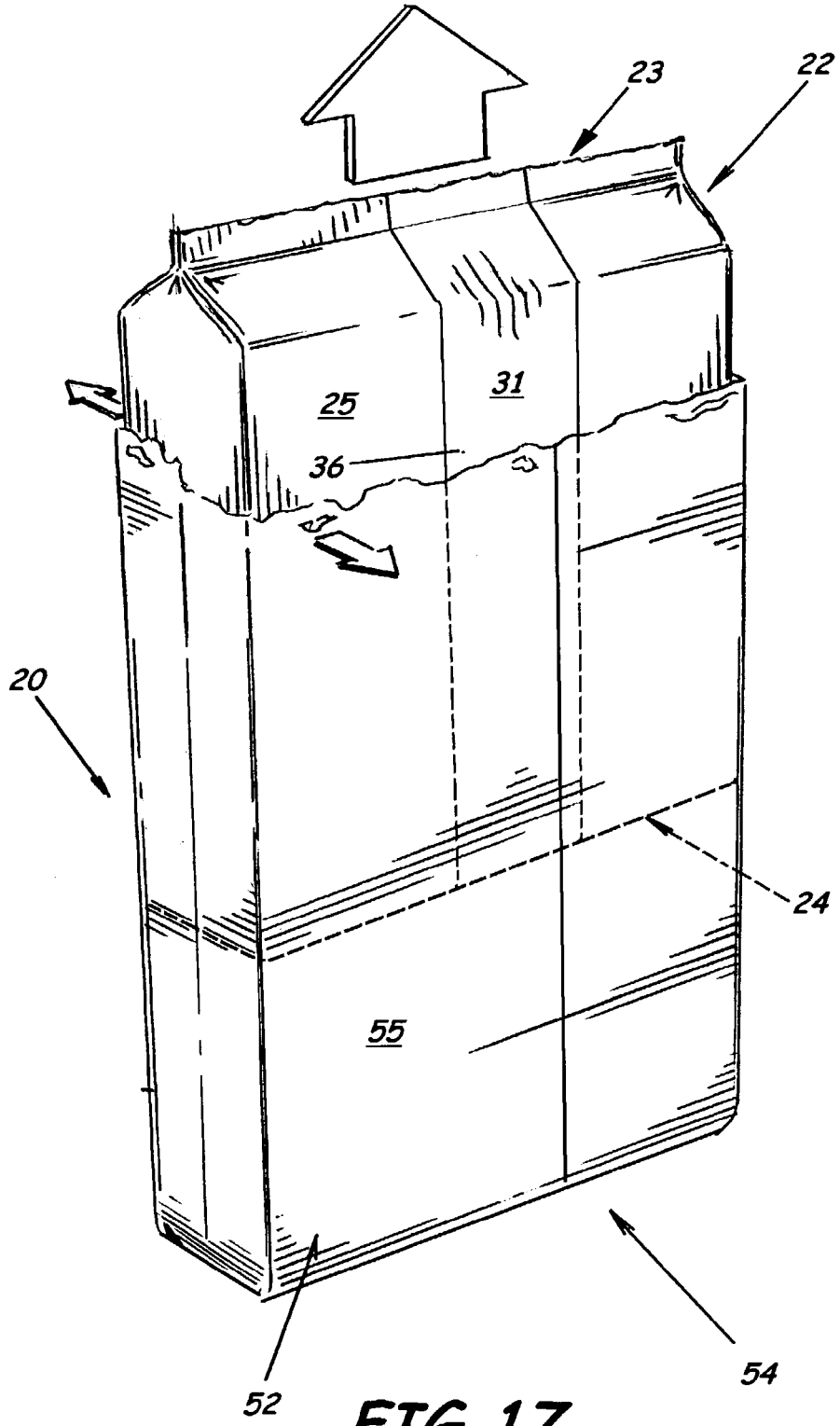
FIG. 17 is a perspective view of a multiwall vented bag having an inner tube pouch thereof being readily removed from an outer tube body according to an embodiment of the present invention.

As shown in an embodiment of a bag in FIGS. 8 and 17, shown inside an external bag or outer tube, the closed end 24 of the tube is heat-sealed during the bag making process (see, e.g., FIGS. 8–9). The heat seal 28 seals both the closed end 24 of the tube 22 and the end of the channel space 42 adjacent the closed end 24. For example, to enhance the ease of manufacturing or forming a bag 20, the closed end 24 of the tube 22 and the closed end region 54 of the outer tube 52 can collectively or in combination pass through a radiant set of heat bars as understood by those skilled in the art to heat the combination of the closed end 24 and at least portions of the closed end region 54 from outside of the outer tube 52 so that the heat also softens or melts the plastic material of the tube 22 and the plastic strip 31. As will be understood by those skilled in the art, however, other sealing techniques or methods can be used as well according to the present invention for sealing the ends of the tube body and for attaching the plastic strip to the tube body such as radio frequency, microwave, sonic, infrared, or other techniques. The closed end 24 and the at least portions of the closed end region 54 can then pass through a nip roller such as illustrated to enhance or form the heat seal 28 under nip or contact pressure. Other examples, as understood by those skilled in the art, can be used as well according to the present invention. An embodiment of the present invention advantageously allows the end product packaging bag ("internal bag") to be utilized within an external bag formed of a porous material or within a bag formed of nonporous material preferably providing that it includes provisions to allow the release of trapped air. Various methodologies used include bonding the closed end 24 of the internal bag to the external bag, using a plurality of beads of adhesive 64 or similar methodology, on only one-half or one side of the tube 22. This provides for the internal bag to be detachably connected to the innermost ply of the external bag as described above herein.

Figure 12:
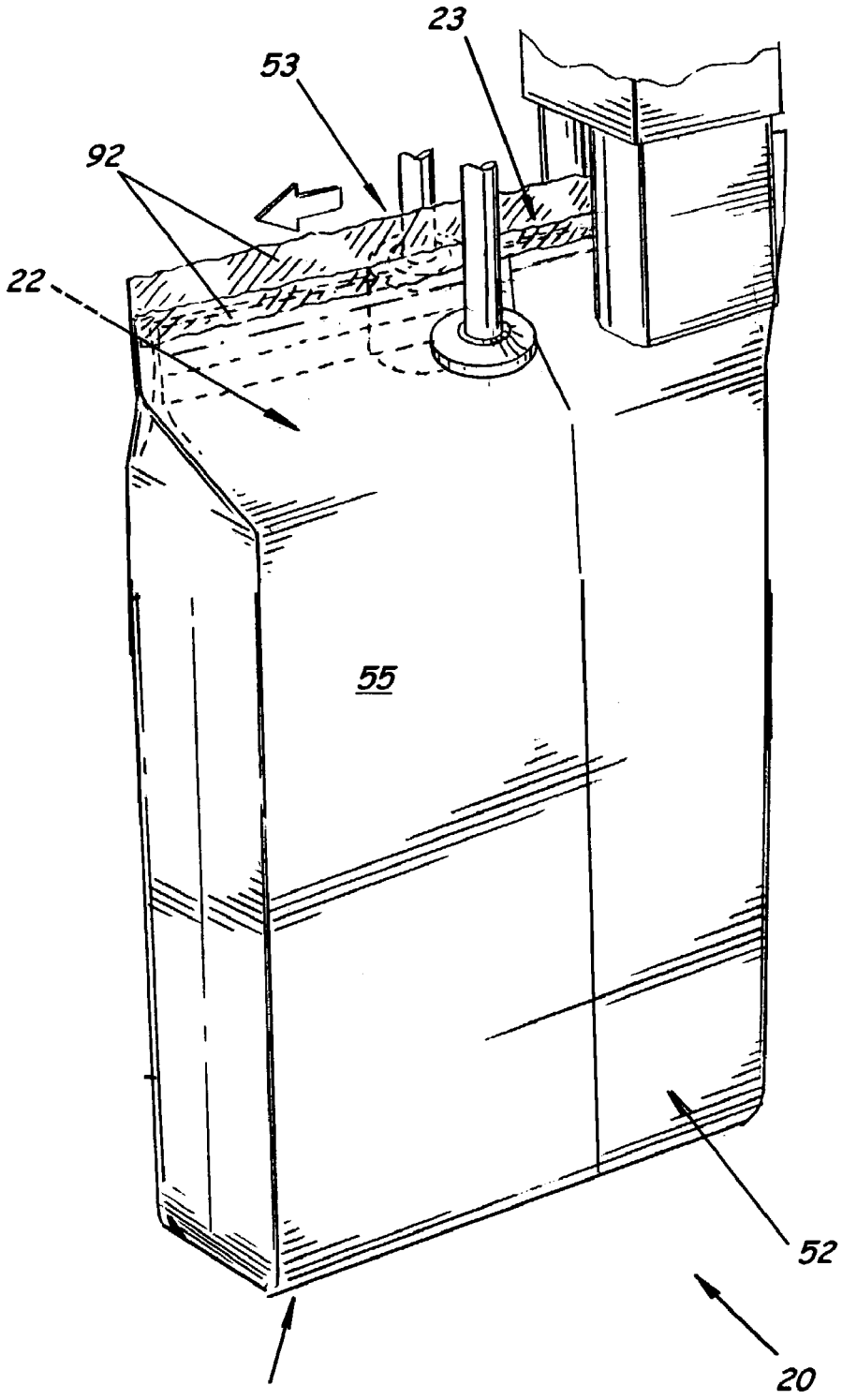
FIG. 12 is a perspective view of a multiwall vented bag showing a heat seal being formed on an open end of an inner tube thereof according to an embodiment of the present invention.
Figure 13:
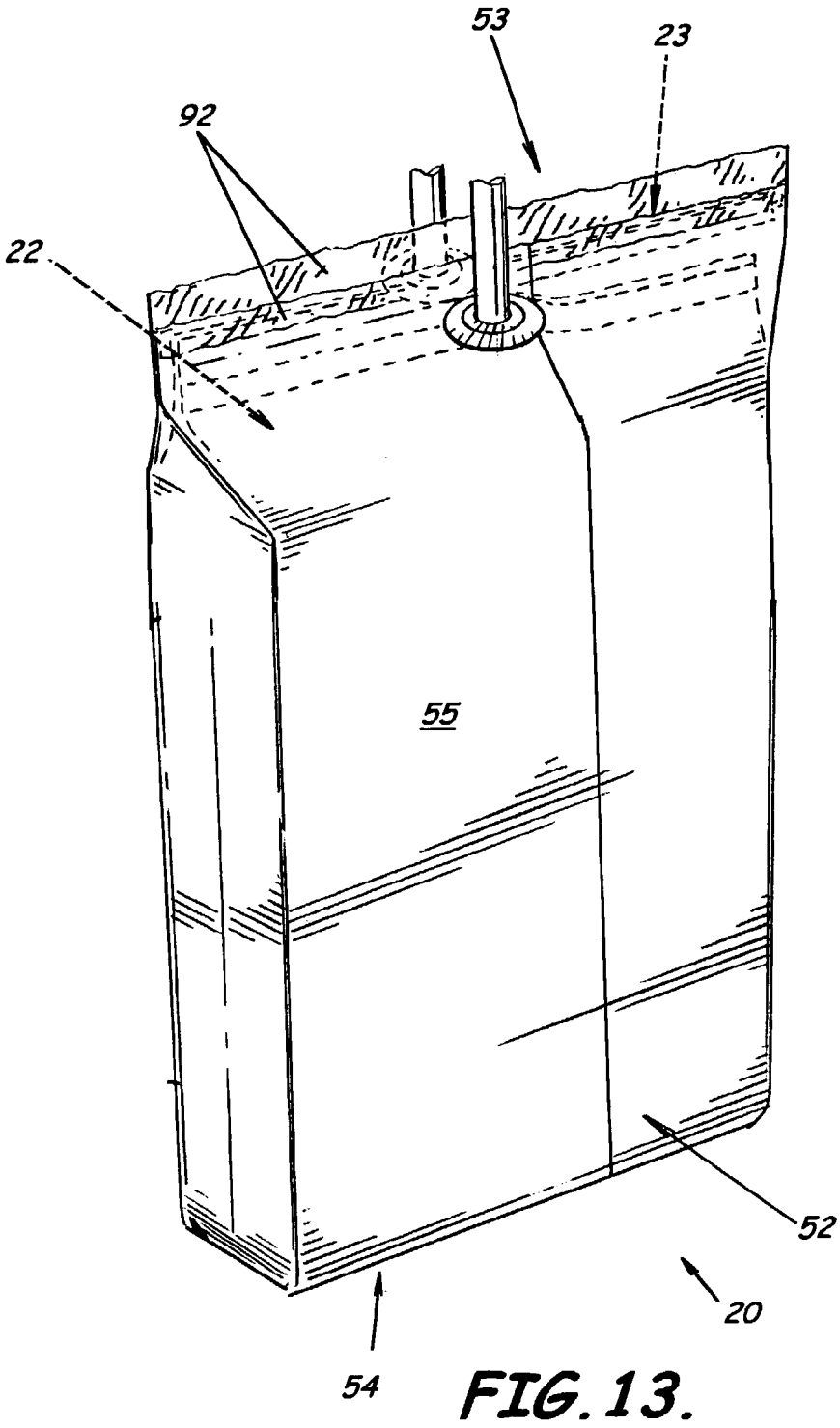
FIG. 13 is a perspective view of a multiwall vented bag having filler material therein and showing an inner tube forming a pouch being separated from an outer tube body during closing of an open end region thereof according to an embodiment of the present invention.
Figure 14:
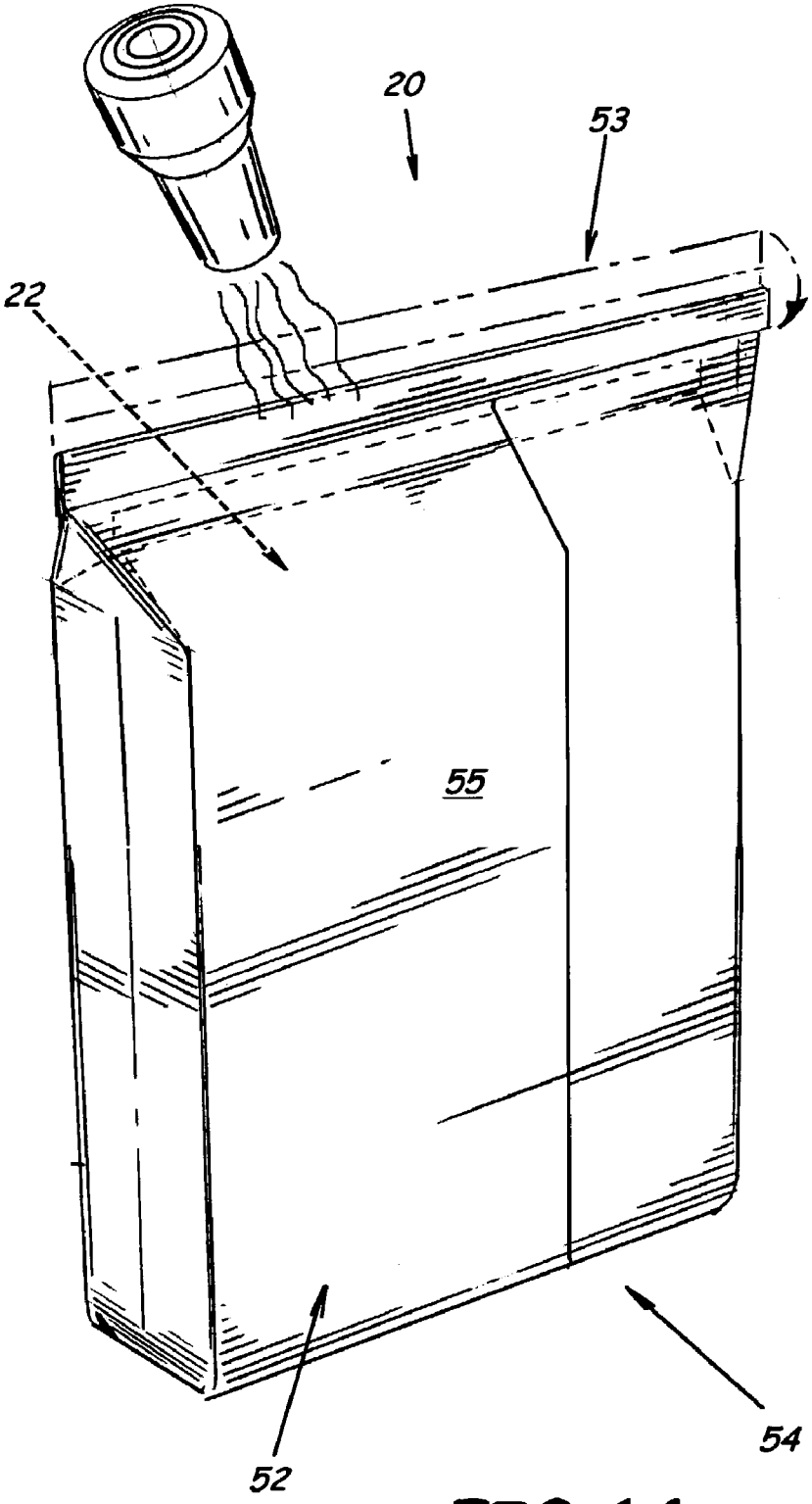
FIG. 14 is a perspective view of a pinch top closure of an open end region of an outer tube of a multiwall vented bag according to an embodiment of the present invention.

Once the end product packaging bag has been filled with the material, in the preferred embodiment, the user can heat seal the open end 23 closed (see FIG. 12). This open end 23 sealing can be performed somewhat like the description above with respect to the closed end 24 by also using heat sealing such as a set of radiant heat bars and a nip roller or set of rollers, as shown and as understood by those skilled in the art, passing over outer surfaces of the outer tube 52. The heat sealing of the open end 23 of the bag correspondingly seals the channel space 42 adjacent the open end 23 of the tube 22. Although only heat sealing methodology has been elaborated on regarding sealing the open and closed ends 23, 24 of the tube 22, and the open and closed ends of the channel space 42, other sealing methodologies, as desired, can be used and still comply with the spirit of the various embodiments of the present invention as will be understood by those skilled in the art. Note also, it is a significant advantage of an embodiment of the present invention to form the end product packaging bag through use of a continuous unseamed plastic film rather than by forming the plastic material tube 22 by heat or otherwise sealing longitudinal edges of a flat sheet or web to form a tube 22 with a longitudinal seam. It is a further advantage to form or use a continuous unseamed plastic film rather than creating a tube 22 having a longitudinal seam formed by overlapping longitudinal margins of the flat sheet or web.

As perhaps best shown in FIG. 6, the present invention still also advantageously provides an apparatus for forming a vented bag 20. The apparatus includes a supply 27 of a tube 22 of at least one ply of plastic material, at least a pair of spaced-apart rollers, such as a pair of spaced-apart pair of rollers 62, 63 as shown. Each of the at least a pair of spaced-apart rollers 62, 63 is positioned to receive the tube 22, a plate member 29, such as formed of a metal material, is positioned in the tube 22 between the at least a pair of space-apart rollers 62, 63, and a perforator roll 21 is positioned adjacent a first outer surface of the plate member 29 so that the plate member 29 operates as a stop for the perforator roll 21 to prevent perforation of a second opposing outer surface of the tube 22 and yet allowing perforation of the first outer surface of the tube 22 to form a plurality of spaced apart vent openings in the first outer surface of the tube 22. The perforator roll 21 can have one or more perforating pins 19, or other perforating member as understood by those skilled in the art, associated with the roll 21, such as connected to an outer surface of the roll, when the perforator roll 21 rotates, e.g., by a drive as understood by those skilled in the art, and contacts the tube 22. The tube 22 of at least one ply of plastic material can extend in a substantially horizontal orientation between the at least one pair of spaced-apart rollers during travel in a preselected manufacturing direction as illustrated in FIG. 6, and the perforator roll 21 can overlie the plate member 29 between the at least one pair of spaced-apart rollers 62, 63 and overlie a substantially horizontal extending first outer surface of the tube 22 to form the plurality of spaced-apart vent openings 26 therein when rotating and contacting the tube 22. The plate member 29 is positioned to be suspended within the tube 22 between the at least one pair of spaced-apart rollers 62, 63 to thereby define a floating plate, and the floating plate 29 can travel or move within the tube 22 between the at least one pair of spaced-apart rollers 26, 28 in a suspended position when the tube 22 is being perforated with the perforator roll 21 and when the tube 22 travels between the at least one pair of spaced-apart rollers 62, 63.

The apparatus can also include the perforator roll 21 being a first perforator roll, and the apparatus further having a separate supply 37 of plastic strip 31 of material, a second perforator roll 38 having a perforating pin 39, or other perforating member as understood by those skilled in the art, positioned to contact the plastic strip 31 to form a plurality of spaced apart vent openings in the plastic strip 31, and an adhering device 41, such as an adhesive applicator mounted on a frame member as shown, a sealer, other adherer, and/or in combination with one or more press rollers 66, positioned adjacent the plastic strip 31 and the tube 22 in a preselected region to adhere the plastic strip material to the tube 22 to thereby form a vented seal zone having a channel space formed between surfaces of the plastic strip and the tube 22 so that the combination of the plurality of vent openings 26 in the tube 22 and the plurality of vent openings 36 in the plastic strip 31 are positioned to not align so as to create a tortuous path to reduce product sifting and insect infestation when product is positioned within the tube 22 and so that air within the tube travels through both of the plurality of vent openings in the tube and the plurality of vent openings in the plastic strip. The at least one ply of plastic material of the tube 22 can be formed of a continuous seamless, tubular, plastic film, the tube 22 can form an inner tube, and the apparatus can further have a supply of porous material 57, 58, 59 a roll 69 or other conveyor, and an attaching device 67, 68, such as a laminator, sealer, press, roller, and/or a combination, positioned to attach the inner tube 22 to inner surfaces of an outer tube 52 formed of the porous material 57, 58, 59 to substantially surround the inner tube 22 such as during shaping or forming as understood by those skilled in the art. A separator (such as indicated by the "To Cutter and Former" block), such as a knife, a cutter, a cutting roll, or other separator as understood by those skilled in the art, can then be positioned downstream to selectively separate a plurality of preselected portions of the attached inner and outer tubes, further shape or form the bag such as by folding over and sealing outer tube portions after cutting or separating as understood by the those skilled in the art, and close at least one end of the separated plurality of preselected portions to thereby define a plurality of separate multiwall bags 20.

As shown in FIGS. 1–17, and perhaps as best illustrated in FIGS. 6–7 and 12–17, in addition to the multiwall bag 20 having a vent seal zone 40, the present invention also advantageously provides methods of forming and using a multiwall vented bag 20, a vented bag 20, or a bag in general. A method of forming a vented bag 20, for example, can include perforating a tube 22 of at least one ply of plastic material to form a plurality of spaced apart vent openings 26 in the tube 22, perforating a separate plastic strip 31 of material to form a plurality of spaced apart vent openings 36 in the plastic strip 31, and adhering the plastic strip 31 adjacent the tube 22 in a preselected region to thereby form a vented seal zone 40 having a channel space 42 formed between surfaces of the plastic strip 31 and the tube 22 so that the combination of the plurality of vent openings 26 in the tube 22 and the plurality of vent openings 36 in the plastic strip 31 are positioned to not align so as to create a tortuous path to significantly reduce product sifting and insect infestation when product is positioned within the tube 22 and so that air within the tube 22 travels through both of the plurality of vent openings 26 in the tube 26 and the plurality of vent openings 36 in the plastic strip 31.

The method of forming a bag 20 can also include the at least one ply of plastic material of the tube 22 being a continuous seamless, tubular, plastic film. Also, the tube 22 can be an inner tube, and the method can further include attaching the inner tube 22 to inner surfaces of an outer tube 52 formed of a porous material to substantially surround the inner tube 22. The plastic strip 31 can extend substantially the entire longitudinal extent of inner tube 22, and the outer tube 52 can be formed of a plurality of layers 57, 58, 59 of porous material so that air exiting the inner tube 22 travels into or enters the porous material of the outer tube 52 and then exits or passes into atmosphere. The method can also include heat sealing an end of the tube 22 defining a closed end of the inner tube and heat sealing the channel space 42 adjacent the closed end 24 of the inner tube 22. The method can also include heat sealing the open end 23 of the inner tube 22 and an upper end of the channel space 42 positioned adjacent the open end 23 of the inner tube 22 after filler material is filled therein to a selected level to thereby seal the open end 23 of the inner tube 22 and the upper end of the channel space 42. The method further can include severing, e.g., using score lines through the outer tube of the bag (FIG. 13) as understood by those skilled in the art, or using some other separating technique as understood by those skilled in the art, the inner tube 22 from the open end 53 of the outer tube 52 to thereby form a sealed plastic pouch within a paper outer bag.

The tube 22 as described above and as illustrated herein can be an inner tube 22, and the method can further include forming an outer tube 52 positioned to substantially surround outer surfaces of the inner tube 22. The outer tube 52 can have a closed end region 54, an open end region 53 being initially in an open position and adapted to receive filling material therethrough, and an outer tube body 55 extending between the open end region 53 and the closed end region 54 and overlying the plastic strip 31. The outer tube 52, for example, can be formed by laminating a plurality of stepped layers 57, 58, 59 of a porous material. The method of forming a bag 20 still further can include forming selective regions of adhesive material between inner surfaces of the closed end region 54 of the outer tube body 55 and outer surfaces of the inner tube 22 so that the closed end 24 of the inner tube 22 is detachably adhered to the closed end region 54 of the outer tube 52, so that the inner tube 22 remains adhered to the outer tube 52 until after the bag 20 is filled to a selected level with filling material, and so that a user of the bag 20 can readily remove the inner tube 22 from the outer tube 52 without damage to the inner tube 22 when the inner tube 22 has filling material positioned therein. The method can also include forming or supplying a plastic strip 31 of at least one ply of plastic material 37. More particularly, in an embodiment, the plastic material strip 31 is formed out of at least one ply of plastic film 37, and is cut at approximately four inches wide, and has a length approximately equal to the length of the inner tube body 25 (see FIGS. 1–2 and 6). Significant deviations from this size is possible, however, and still remain within the spirit of this disclosure. The method can also include perforating the inner tube 22 and plastic strip 31 with at least one vent opening 26, 36, using a perforator roll 21, 58 or knife stack (see, e.g., FIG. 6) having a perforation pin 19, 39 attached to the roll 21, 58. This forms a plurality of spaced apart vent openings 26, 36, in both the inner tube 22 and the plastic strip 31, to allow air to pass from within the inner tube body 25, through the plurality of spaced apart inner vent openings 26 or 36, and through the plurality of spaced apart outer vent openings 36 or 26, depending on whether the plastic strip 31 is configured on the outer surface or the inner surface of the inner tube 22. In an embodiment, the perforations 26, 36, are made to the inner tube 22 and plastic strip 31 at temporally separate instances along a direction of manufacture or travel of material in forming one or more bags.

According to an embodiment of the method, as perhaps best shown in FIG. 9, the method can further include forming a satchel bottom 81 upon outer tube 52 as understood by those skilled in the art. The satchel bottom 81, for example, can be cut, formed, and folded to retain the closed end 24 of the inner tube 22. In an embodiment, a plurality of parallel slits 49 are cut in the first and second, e.g., front and back, sides of the outer tube 52. The depth and spacing are accomplished to optimize the lateral distances between the slits 49 on sequential plies as understood by those skilled in the art. In an embodiment, the paper ply or porous material of the layers 57, 58, 59 of the outer tube 52, as described above, is stepped longitudinally and oppositely on the front and back or first and second sides, in order to provide an easier folding capability on the closed end region 54 and a smoother contour of a seal of the adhesive material 92 on the open end region 53, especially when an embodiment calls for the open end region 53 to include a pinch step closure pattern. Nevertheless, in the embodiment calling for a satchel bottom 81, a main score line and a series of smaller score lines are made across all paper or porous material plies 57, 58, 59, thus allowing the folding of the outer tube closed end region 54, as understood by those skilled in the art.

As shown in FIGS. 11–14, in the current described form, the multiwall bag 20 can be ready to be filled with a filler material. The method of forming the bag 20 correspondingly includes the step of sealing the bag 20 closed upon filling the bag 20 with the filler material. In this embodiment, the method further includes sealing the inner tube 22 and sealing the outer tube 52. Although other methodologies are available, as noted above, the preferred methodology of sealing the outer tube 52 is accomplished by the use of the pre-applied hot melt 92 or other adhesive material applied to the open end region 53 that can be reactivated by the user after the bag 20 has been filled with product. One of the many methodologies for reactivating the open end region 53 adhesive, for example, include use of a hot air blast as understood by those skilled in the art (see FIG. 14).

Although other methodologies are available, as noted above, the preferred methodology of sealing the inner tube 22 is accomplished by use of a pair of heated bars or rolls, as is described previously, which are actuated compressibly against opposing sides or front and back surfaces, of the outer surface of the inner tube 22 adjacent the open end 23. The inner tube opening 23 can be pressed into a substantially flat form. The bars are heated to a sufficient temperature to fuse the open end 23 of the inner tube 22 to itself, thus forming an airtight seal. The temperatures and pressures required in this embodiment and in alternative embodiments using different fusion bonding methodologies are well known by those skilled in the art. Alternatively, the open end inner tube sealing can be accomplished using a non-heat responsive method as known by those skilled in the art. In either case, if not already accomplished, the heat sealing or other selected methodology of sealing the open end 23 of the inner tube 22, correspondingly seals the channel space 42 adjacent the open end 23 of the inner tube 22. In an embodiment of a bag 20, the inner tube 22 is to be housed independently of the outer tube 52 after filling. In this embodiment, following the heat sealing and while the heated fusion area is still malleable, a cutter or separator such as a pair of beveled compression rollers are compressibly and traversely drawn across the fusion area to sever the inner tube 22 within the outer tube 52 without severing the outer tube 52 (see, e.g., FIG. 13). This allows for hygienic removal of the inner tube at destination (see FIG. 17).

As illustrated in FIG. 6, as well as other figures, a method of forming a vented bag 20 is provided which includes positioning a plate member 29 within a tube 22 of at least one ply of plastic material 27 and rotatingly perforating the tube 22 with a perforator roll 21 positioned adjacent a first outer surface of the plate member 29 so that the plate member 29 operates as a stop for the perforator roll 21 to prevent perforation of a second opposing outer surface of the tube 22 and yet allowing perforation of the first outer surface of the tube to form a plurality of spaced apart vent openings 26 in the first outer surface of the tube 22. The method can also include perforating a separate plastic strip 31 of material 37 to form a plurality of spaced apart vent openings 36 in the plastic strip 31 and adhering the plastic strip 31 adjacent the tube 22 in a preselected region to thereby form a vented seal zone having a channel space formed between surfaces of the plastic strip and the tube so that the combination of the plurality of vent openings 26 in the tube 22 and the plurality of vent openings 36 in the plastic strip 31 are positioned to not align so as to create a tortuous path to reduce product sifting and insect infestation when product is positioned within the tube 22 and so that air within the tube 22 travels through both of the plurality of vent openings 26 in the tube 22 and the plurality of vent openings 36 in the plastic strip 31.

The at least one ply of plastic material 27 of the tube 22 preferably is a continuous seamless, tubular, plastic film that is used to form an inner tube. The method can further include attaching the inner tube 22 to inner surfaces of an outer tube 52 formed of a porous material, 57, 58, 59, e.g., being transported in a substantially horizontal plane from a flooring surface, to substantially surround the inner tube 22. The plastic strip 31 extends substantially the entire longitudinal extent of inner tube 31, and the outer tube 52 has a plurality of layers 57, 58, 59 of porous material, e.g., paper, so that air exiting the inner 22 tube travels into the porous material 27 of the outer tube 52 and into atmosphere therefrom. The tube 22 of the plastic material 27 extends in a substantially horizontal orientation, e.g., this can include a slight upward slope, e.g., less than 45 degrees from the substantially horizontal plane of the extent of the porous material as illustrated or a slight downward slope, between at least one pair of spaced-apart rollers during travel in a preselected manufacturing direction. The plate member 29 is positioned in the tube 22 between the at least one pair of spaced-apart rollers 62 63, and the perforator roll 21 overlies the plate member between the at least one pair of spaced-apart rollers and overlies a substantially horizontal extending first outer surface of the tube to form the plurality of spaced-apart vent openings therein.

The plate member 29 can be a metal material or other effective stop material for the perforating pin 19 on the perforator roll 21. The plate member 29 is positioned to be suspended within the tube between the at least one pair of spaced-apart rollers 62, 63 to thereby define a floating plate. The floating plate 29 travels within the tube 22 between the at least one pair of spaced-apart rollers 62, 63 in a suspended position when the tube 22 is being perforated with the perforator roll 21 during travel between the at least one pair of spaced-apart rollers 62, 63. The method can further include heat sealing an end of the tube defining a closed end of the inner tube and heat sealing the channel space adjacent the closed end of the inner tube. The method can still further include heat sealing the open end of the inner tube and an upper end of the channel space positioned adjacent the open end of the inner tube after filler material is filled therein to a selected level to thereby seal the open end of the inner tube and the upper end of the channel space.

As discussed above herein, the tube 22 can be or form an inner tube 22, and the method can also further include forming an outer tube 52 positioned to substantially surround outer surfaces of the inner tube. The outer tube 52 has a closed end region, an open end region being initially in an open position and adapted to receive filling material therethrough, and an outer tube body extending between the open end region and the closed end region and overlying the plastic strip. The outer tube 52 can be formed by laminating a plurality of stepped layers 57, 58, 59 of a porous material. The method also can include forming selective regions of adhesive material between inner surfaces of the closed end region of the outer tube body and outer surfaces of the inner tube so that the closed end of the inner tube is detachably adhered to the closed end region of the outer tube, so that the inner tube remains adhered to the outer tube until after the bag is filled to a selected level with filling material, and so that a user of the bag can readily remove the inner tube from the outer tube without damage to the inner tube when the inner tube has filling material positioned therein.

A method of using a multiwall bag 20 having a vent seal zone 40 associated therewith, for example, includes filling first and second multiwall bags 20 with filler material. Each of the first and second multiwall bags 20 have an inner plastic tube 22, a vent seal zone 40 formed by a plastic strip 31 attached to a preselected region 32 of the inner plastic tube 22, and an outer tube 52 formed of a plurality of layers 57, 58, 59 of porous material attached to and substantially surrounding the inner tube 22. The inner plastic tube 22 has a plurality of spaced-apart vent openings 26 and the plastic strip 31 includes a plurality of spaced-apart vent openings 36 not aligned with the plurality of space-apart vent openings 26 of the inner plastic tube 22 so as to create a tortuous path therebetween. The vent seal zone 40 also includes a channel space 42 positioned between a surface of the plastic strip 31 and a surface of the inner tube body 25. The method also includes closing each of an open end 23 of the first and second multiwall bags 20 after filler material is filled therein and stacking the second multiwall bag 20 to overlie and contact the first multiwall bag 20 so that pressure from weight of the second multiwall bag 20 increases the air flow from the inner tube 22 of the first multiwall bag 20, through both the plurality of vent openings 26 in the inner tube 22 and the plurality of openings 36 in the plastic strip 31, and through the porous material of the outer tube 52 to atmosphere (see, e.g., FIGS. 15–16). The method can also include compressing the first multiwall bag 20 so that trapped gas or air flows from within the inner tube body 22, through the innermost plurality of spaced-apart vent openings 26 or 36, through the channel space 42, along the tortuous path, through the outermost plurality of spaced-apart vent openings 26 or 36, and into an innermost layer 57 of the plurality of layers 57, 58, 59 of porous material, through at least one overlying layer 58, 59 of a plurality of layers 57, 58, 59 of porous material, and into atmosphere therefrom.

Figure 11:
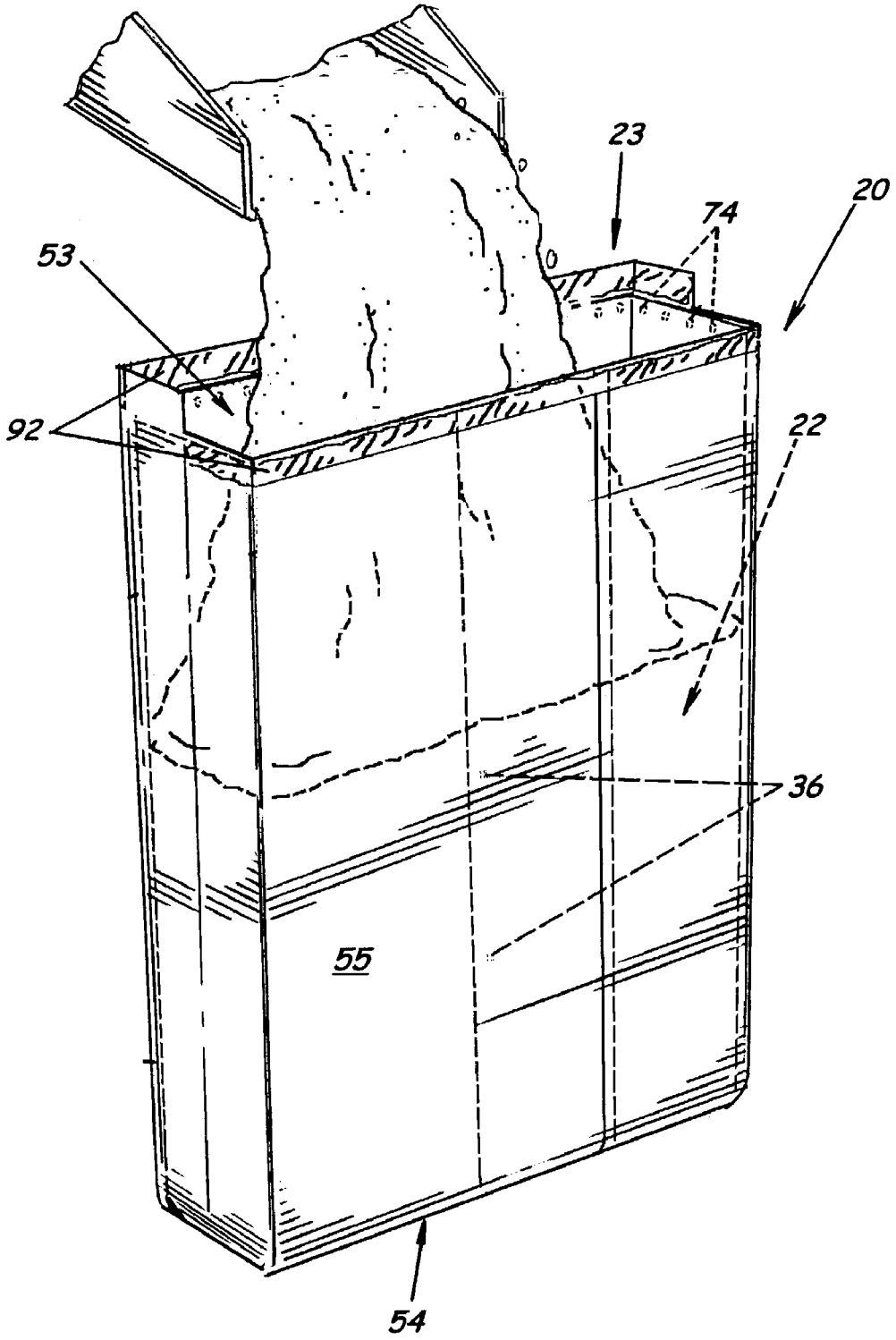
FIG. 11 is a perspective view of filler material filling a multiwall vented bag according to an embodiment of the present invention.

Another method of using a bag 20 having a vent seal zone 40 associated therewith, for example, includes filling a bag 20 with filler material (see FIG. 11). The bag 20, for example, has a plastic tube 22 including a closed end 24, an open end 23 through which filler material flows during filling, and a tube body 25 extending between the open end 23 and the closed end 24 and a vent seal zone 40 defined by a plastic strip 31 attached to a preselected region 32 of the plastic tube 22. The plastic tube 22 includes a plurality of spaced-apart vent openings 26 and the plastic strip 31 includes a plurality of spaced-apart vent openings 36. The vent seal zone 40 also includes a channel space 42 positioned between a surface of the plastic strip 31 and a surface of the tube body 22. The method also includes heat sealing the open end 23 of the tube body 25 and an upper end of the channel space 42 positioned adjacent the open end 23 of the tube body 25 after filler material is filled therein to a selected level to thereby seal the open end 23 of the tube body 25 and the upper end 23 of the channel space 42 (see, e.g., FIGS. 12–14). The method can also include compressing the bag 20 so that trapped gas or air flows from within the tube body 22, through the innermost plurality of spaced-apart vent openings 26 or 36 of the vent seal zone 40, through the channel space 42, along the tortuous path, through the outermost plurality of spaced-apart vent openings 26 or 36 of the vent seal zone 40 (see, e.g., FIGS. 15–16).

Figure 15:
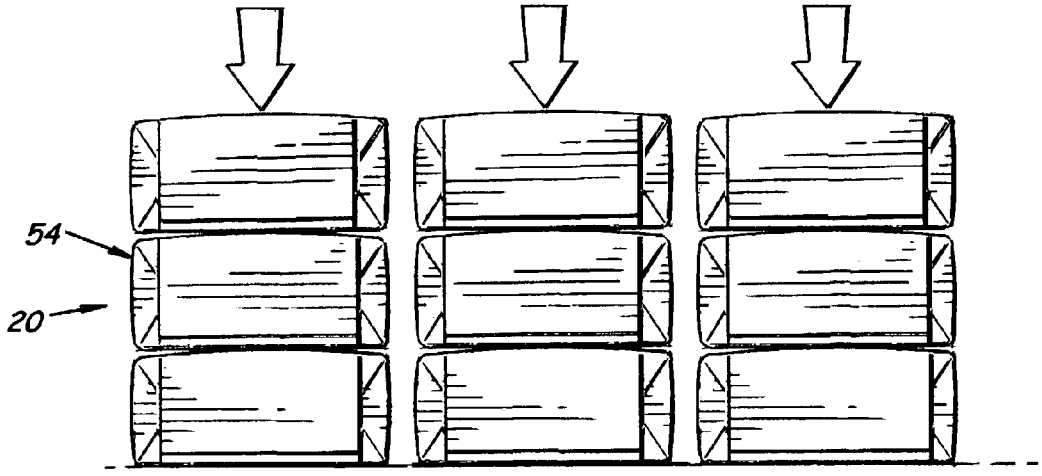
FIG. 15 is an elevational view of a stack of multiwall vented bags after closure and when air is being released therefrom according to an embodiment of the present invention.
Figure 16:
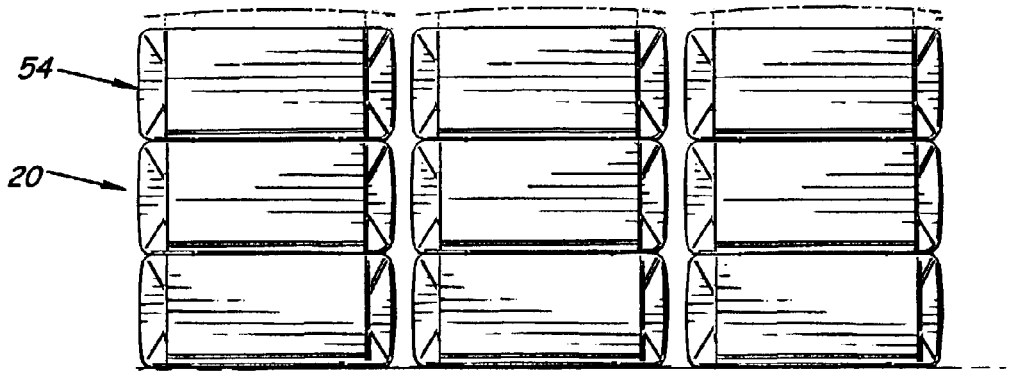
FIG. 16 is an elevational view of a stack of multiwall vented bags after air is initially released therefrom according to an embodiment of the present invention.

As illustrated in FIGS. 15–16, in an embodiment of a bag 20, the method can further include compressing the bag 20. The user either palletizes or otherwise stacks the bags 20, allowing the automatic bleed of the trapped gas or air. Alternatively, the user can manually compress the bag 20 to increase the rate of bleed prior to stacking. The air or gas, in turn, then passes from the tube 22 through the porous material of outer tube 52 and generally will travel along the path of least resistance, such as through auxiliary slits or openings formed in the porous material first if these are formed in the outer tube 52 in the innermost layer 57 or other layers 58, 59. As shown in FIG. 17, in an embodiment, the method can advantageously include hygienically removing and/or sterilizing the outer surface of the inner tube 22. Upon arrival at destination, the end-user may cut or otherwise separate the outer tube 52 from the inner tube 22. This advantageously provides the user the ability to then sterilize or otherwise clean the outer surface of the inner tube 22 prior to unloading the product or filler material from the inside of inner tube 22.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the attached claims.

What is claimed is:

1. A multiwall bag comprising:

an inner tube formed of a plastic material and having an open-end, a closed end positioned opposite the open end, an inner tube body extending between the open end and the closed end initially in an open position and adapted to receive filling material therethrough, and a plurality of spaced-apart inner vent openings formed in the inner tube body;

a plastic strip overlying and adhering to a preselected region of the inner tube body and positioned to overlie the plurality of spaced-apart inner vent openings, the plastic strip extending substantially the entire longitudinal extent of tube body and including a plurality of spaced-apart outer vent openings to allow air to pass from within the inner tube body, through the plurality of space-apart inner vent openings, and through the plurality of spaced-apart outer vent opening, the combination of the plastic strip and the preselected region of the inner tube body defining a vent seal zone, the vent seal zone including a channel space positioned between an inner surface of the plastic strip and an outer surface of the inner tube body, the channel space also allowing air to flow therethrough and extending between the plurality of spaced-apart inner vent openings and the plurality of spaced-apart outer vent openings so that the plurality of spaced-apart inner vent opening and the plurality of spaced-apart outer vent opening are not aligned and thereby form a tortuous path to reduce the risk of insect infestation and to reduce product sifting when product is positioned in the bag; and an outer tube positioned to substantially surround outer surfaces of the inner tube, the outer tube having a closed end region positioned closely adjacent the closed end of the inner tube, an open end region positioned closely adjacent the open end of the inner tube, positioned initially in an open position, and adapted to receive filling material therethrough, and an outer tube body extending between the open end region and the closed end region and overlying the plastic strip, the outer tube being formed of a plurality of layers of naturally porous material to thereby allow air released from the vent seal zone to pass out of the bag through each of the plurality of layers of porous material.

2. A multiwall bag as defined in claim 1, wherein the strip has a substantially narrower lateral extent than the inner tube body, and wherein the plastic material of the inner tube comprises a seamless, tubular, plastic film.

3. A multiwall bag as defined in claim 2, wherein the channel space of the vent seal zone is substantially elongate and extends substantially the length of the inner tube body between the open end and the closed end thereof, and wherein the bag further comprises a pair of spaced-apart longitudinal adhesive regions positioned between outer surfaces of the inner tube body and a pair of elongate inner surfaces of the plastic strip so that the channel space extends between the pair of spaced-apart longitudinal adhesive regions and so that air flows from within the inner tube body, through the plurality of spaced-apart inner vent openings, through the channel space extending between the pair of spaced-apart longitudinal adhesive regions, along the tortuous path, through the plurality of spaced-apart outer vent openings, and into an innermost layer of the plurality of layers of porous material, and through at least one overlying layer of the plurality of layers of porous material.

4. A multiwall bag as defined in claim 3, wherein the plurality of vent openings of the inner tube body are positioned in a preselected spaced relationship along a longitudinal extent of the inner tube body, wherein the plurality of vent openings of the plastic strip are positioned in a preselected spaced relationship along a longitudinal extent of the plastic strip, and wherein the plurality of vent openings of the plastic strip are positioned spaced apart from and do not directly overlie the plurality of vent openings of the inner tube body.

5. A multiwall bag as defined in claim 4, further comprising an adhesive material positioned between the inner tube body adjacent the open end thereof and the outer tube body adjacent the open end thereof so that the inner tube body remains attached to the outer tube body during filling thereof and separates from the outer tube body after the inner tube body has been filled with product to a preselected level.

6. A multiwall bag as defined in claim 5, wherein the closed end of the inner tube detachably adheres to the closed end region of the outer tube so that the inner tube remains adhered to the outer tube prior to filling of the bag with filling material and so that a user of the bag can selectively remove the inner tube from the outer tube without damage to the inner tube when the inner tube has filling material positioned therein.

7. A multiwall bag as defined in claim 6, wherein the outer tube comprises a plurality of layers of porous material, wherein the porous material comprises paper and wherein at least an innermost layer of the plurality of layers of the outer tube has a plurality of auxiliary perforations formed therein.

8. A multiwall bag as defined in claim 7, wherein the vent seal zone further includes a lower seal positioned closely adjacent the closed end of the inner tube and the closed end region of the outer tube, the lower seal being associated with the closed end of the inner tube so that the lower seal is formed integral with the closed end of the inner tube, and wherein the vent seal zone is adapted to include an upper seal positioned closely adjacent the open end of the inner tube and the open end region of the outer tube, the upper seal being associated with the open end of the inner tube so that the upper seal is adapted to be formed when the open end of the inner tube is sealed.

9. A multiwall bag comprising:

an inner tube formed of a plastic material and having an open-end, a closed end positioned opposite the open end, an inner tube body extending between the open end and the closed end, and at least one vent opening formed in the inner tube body;

a strip of material adhering to a preselected region of the inner tube body and positioned to lie adjacent the at least one vent opening of the inner tube body, the strip including at least one vent opening formed therein to allow air to pass from within the inner tube body, through both of the at least one vent opening of the inner tube body, and the at least one vent opening of the strip, the combination of the strip and the preselected region of the inner tube body defining a vent seal zone; and an outer tube positioned to substantially surround outer surfaces of the inner tube, the outer tube having a closed end region positioned closely adjacent the closed end of the inner tube, an open end region positioned closely adjacent the open end of the inner tube, positioned initially in an open position, and adapted to receive filling material therethrough, and an outer tube body extending between the open end region and the closed end region and overlying the inner tube body and the strip, the outer tube being formed of a naturally porous material to thereby allow air released from the vent seal zone to pass out of the bag through the porous material.

10. A multiwall bag as defined in claim 9, wherein the strip has a substantially narrower lateral extent than the inner tube body and extends substantially the entire longitudinal extent of the inner tube body, wherein the plastic material of the inner tube comprises a seamless, tubular, plastic film, and wherein the strip of material comprises a sheet of plastic material to thereby define a plastic strip.

11. A multiwall bag as defined in claim 10, wherein the vent seal zone includes a channel space positioned between an inner surface of the plastic strip and an outer surface of the inner tube body, the channel space also allowing air to flow therethrough and extending between the at least one vent opening of the inner tube body and the at least one vent opening of the plastic strip so that the at least one vent opening of the inner tube body and the at least one vent opening of the plastic strip are not aligned and thereby form a tortuous path to reduce the risk of insect infestation and to reduce product sifting when product is positioned in the bag.

12. A multiwall bag as defined in claim 11, wherein the at least one vent opening of the inner tube body comprises a plurality of vent openings of the inner tube body positioned in a preselected spaced relationship along a longitudinal extent of the inner tube body, wherein the at least one vent opening of the plastic strip comprises a plurality of vent openings of the plastic strip positioned in a preselected spaced apart relationship along a longitudinal extent of the plastic strip, and wherein the plurality of vent openings of the plastic strip are positioned spaced apart from and do not directly overlie the plurality of vent openings of the inner tube body.

13. A multiwall bag as defined in claim 12, further comprising an adhesive material positioned between the inner tube body adjacent the open end thereof and the outer tube body adjacent the open end thereof so that the inner tube body remains attached to the outer tube body during filling thereof and separates from the outer tube body after the inner tube body has been filled with product to a preselected level.

14. A multiwall bag as defined in claim 13, wherein the closed end of the inner tube detachably adheres to the closed end region of the outer tube so that the inner tube remains adhered to the outer tube prior to filling of the bag with filling material and so that a user of the bag can selectively remove the inner tube from the outer tube, without damage to the inner tube when the inner tube has filling material positioned therein.

15. A multiwall bag as defined in claim 14, wherein the outer tube comprises a plurality of layers of porous material, wherein the porous material comprises paper, and wherein at least an innermost layer of the plurality of layers of the outer tube has a plurality of slits formed therein.

16. A multiwall bag as defined in claim 15, wherein the vent seal zone further includes a lower seal positioned closely adjacent the closed end of the inner tube and the closed end region of the outer tube, the lower seal being associated with the closed end of the inner tube so that the lower seal is formed integral with the closed end of the inner tube, and wherein the vent seal zone is adapted to include an upper seal positioned closely adjacent the open end of the inner tube and the open end region of the outer tube, the upper seal being associated with the open end of the inner tube so that the upper seal is adapted to be formed when the open end of the inner tube is sealed.

17. A multiwall bag comprising:

an inner tube formed of a plastic material and having an open-end, a closed end positioned opposite the open end, an inner tube body extending between the open end and the closed end initially in an open position and adapted to receive filling material therethrough, and a plurality of spaced-apart inner vent openings formed in the inner tube body;

a plastic strip overlying and adhering to a preselected region of the inner tube body and positioned to overlie the plurality of spaced-apart inner vent openings, the plastic strip extending substantially the entire longitudinal extent of tube body and including a plurality of spaced-apart outer vent openings to allow air to pass from within the inner tube body, through the plurality of space-apart inner vent openings, and through the plurality of spaced-apart outer vent opening, the combination of the plastic strip and the preselected region of the inner tube body defining a vent seal zone, the vent seal zone including a channel space positioned between an inner surface of the plastic strip and an outer surface of the inner tube body, the channel space also allowing air to flow therethrough and extending between the plurality of spaced-apart inner vent openings and the plurality of spaced-apart outer vent openings so that the plurality of spaced-apart inner vent opening and the plurality of spaced-apart outer vent opening are not aligned and thereby form a tortuous path to reduce the risk of insect infestation and to reduce product sifting when product is positioned in the bag;

an outer tube positioned to substantially surround outer surfaces of the inner tube, the outer tube having a closed end region positioned closely adjacent the closed end of the inner tube, an open end region positioned closely adjacent the open end of the inner tube, positioned initially in an open position, and adapted to receive filling material therethrough, and an outer tube body extending between the open end region and the closed end region and overlying the plastic strip; and an adhesive material positioned between the inner tube body adjacent the open end thereof and the outer tube body adjacent the open end thereof so that the inner tube body remains attached to the outer tube body during filling thereof and separates from the outer tube body after the inner tube body has been filled with product to a preselected level.

18. A multiwall bag comprising:

an inner tube formed of a plastic material and having an open-end, a closed end positioned opposite the open end, an inner tube body extending between the open end and the closed end, and at least one vent opening formed in the inner tube body;

a strip of material adhering to a preselected region of the inner tube body and positioned to lie adjacent the at least one vent opening of the inner tube body, the strip including at least one vent opening formed therein to allow air to pass from within the inner tube body, through both of the at least one vent opening of the inner tube body, and the at least one vent opening of the strip, the combination of the strip and the preselected region of the inner tube body defining a vent seal zone;

an outer tube positioned to substantially surround outer surfaces of the inner tube, the outer tube having a closed end region positioned closely adjacent the closed end of the inner tube, an open end region positioned closely adjacent the open end of the inner tube, positioned initially in an open position, and adapted to receive filling material therethrough, and an outer tube body extending between the open end region and the closed end region and overlying the inner tube body and the strip; and an adhesive material positioned between the inner tube body adjacent the open end thereof and the outer tube body adjacent the open end thereof so that the inner tube body remains attached to the outer tube body during filling thereof and separates from the outer tube body after the inner tube body has been filled with product to a preselected level.

* * * * *